US010619427B2

(12) United States Patent
Gaskins

(10) Patent No.: US 10,619,427 B2
(45) Date of Patent: Apr. 14, 2020

(54) SUCKER ROD GUIDE AND METHOD OF ADHESION TO A ROD

(71) Applicant: Dustin Gaskins, Knott, TX (US)

(72) Inventor: Dustin Gaskins, Knott, TX (US)

( * ) Notice: Subject to any disclaimer, the term of this patent is extended or adjusted under 35 U.S.C. 154(b) by 162 days.

(21) Appl. No.: 15/789,801

(22) Filed: Oct. 20, 2017

(65) Prior Publication Data

US 2018/0112472 A1 Apr. 26, 2018

Related U.S. Application Data

(60) Provisional application No. 62/410,604, filed on Oct. 20, 2016.

(51) Int. Cl.
*E21B 17/10* (2006.01)

(52) U.S. Cl.
CPC ..... *E21B 17/1078* (2013.01)

(58) Field of Classification Search
CPC ..... E21B 17/1078
See application file for complete search history.

(56) References Cited

U.S. PATENT DOCUMENTS 5,247,990 A * 9/1993 Sudol ..... E21B 17/1042 166/241.3
2002/0092647 A1* 7/2002 Terry ..... E21B 17/1042 166/241.2
2004/0011561 A1* 1/2004 Hughes ..... E21B 21/12 175/57

* cited by examiner

*Primary Examiner* — Giovanna C Wright
*Assistant Examiner* — Brandon M Duck
(74) *Attorney, Agent, or Firm* — Shannon Warren

(57) ABSTRACT

A molded rod guide for guiding and protecting a sucker rod in a fluid mineral extraction setting. Said molded rod guide comprising a two mating portions and a center channel. Said two mating portions comprise a first mating portion and a second mating portion. Said two mating portions are configured to selectively mate with one another and form said center channel. Said two mating portions comprise an assembled configuration and a separated configuration. With said two mating portions in said assembled configuration, said molded rod guide comprises a plurality of flutes, a body portion, a width and a height. Said body portion wraps around said center channel. Said center channel comprises a center axis. Said molded rod guide is configured to selectively surround a portion of a rod by wrapping said center channel around a portion of said rod.

13 Claims, 30 Drawing Sheets

PRIOR ART

SUCKER ROD GUIDE AND METHOD OF ADHESION TO A ROD

CROSS-REFERENCE TO RELATED APPLICATIONS

This application claims benefit to U.S. Patent Application No. 62/410,604 filed on Oct. 20, 2016.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

N/A

None of the known inventions and patents, taken either singularly or in combination, is seen to describe the instant disclosure as claimed.

BRIEF SUMMARY OF THE INVENTION

A molded rod guide for guiding and protecting a sucker rod in a fluid mineral extraction setting. Said molded rod guide comprising a two mating portions and a center channel. Said two mating portions comprise a first mating portion and a second mating portion. Said two mating portions are configured to selectively mate with one another and form said center channel. Said two mating portions comprise an assembled configuration and a separated configuration. With said two mating portions in said assembled configuration, said molded rod guide comprises a plurality of flutes, a body portion, a width and a height. Said body portion wraps around said center channel. Said center channel comprises a center axis. Said molded rod guide is configured to selectively surround a portion of a rod by wrapping said center channel around a portion of said rod. Said plurality of flutes extend in a radially outward direction from said center axis and said body portion.

A molded rod guide for guiding and protecting a sucker rod in a fluid mineral extraction setting. Said molded rod guide further comprises a one or more fill ports, an interior surface, a one or more adhesive channels, a cavity and an adhesive. Said one or more adhesive channels line said interior surface of a center channel. Said one or more adhesive channels comprise spaces between said interior surface on said center channel. Said molded rod guide is configured to selectively attach to a rod by attaching a two mating portions around a portion of said rod, attaching a first mating portion to a second mating portion, injecting said adhesive into said one or more fill ports, and filling said cavity with portions of said adhesive. Said one or more adhesive channels force portions of said adhesive into said interior surface. Said one or more fill ports comprise holes in a portion of a plurality of flutes. Said molded rod guide comprise an exterior surface and an interior surface. Said exterior surface comprises a space within said center channel. Said one or more fill ports is configured to receive a portion of said adhesive and channel a portion of said adhesive between said one or more adhesive channels. Said molded rod guide further comprises a one or more beveled ends at a first end and a second end of said center channel. Said second end are configured to press into said rod with said molded rod guide in an assembled configuration. Said interior surface comprises a space between said center channel, said one or more adhesive channels, and said one or more beveled ends. Said one or more adhesive channels comprise at least a first adhesive channel and a second adhesive channel. Said one or more adhesive channels comprise a one or more gaps configured to allow portions of said adhesive to pass between said one or more adhesive channels. Said one or more beveled ends and said one or more adhesive channels are configured to fit snuggly around said rod. Said interior surface are configured to provide a cavity for holding said adhesive between said one or more adhesive channels, and said one or more beveled ends. Said adhesive is configured to bond said molded rod guide to a portion of said rod. Said one or more adhesive channels and said one or more beveled ends with said adhesive in said interior surface provide mechanical resistance to movement along a center axis.

A method of use of a molded rod guide for guiding and protecting a sucker rod in a fluid mineral extraction setting. Comprising selectively attaching a two mating portions to one another around a portion of a rod and. Filling a space between said two mating portions and said rod with an adhesive. Wherein. Said molded rod guide further comprises a one or more fill ports, an interior surface, a one or more adhesive channels, a cavity and said adhesive. Said one or more adhesive channels line said interior surface of a center channel. Said one or more adhesive channels comprise spaces between said interior surface on said center channel. Said molded rod guide is configured to selectively attach to said rod by attaching said two mating portions around a portion of said rod, attaching a first mating portion to a second mating portion, injecting said adhesive into said one or more fill ports, and filling said cavity with portions of said adhesive. Said one or more adhesive channels force portions of said adhesive into said interior surface. Said one or more fill ports comprise holes in a portion of a plurality of flutes. Said molded rod guide comprise an exterior surface and an interior surface. Said exterior surface comprises a space within said center channel. Said one or more fill ports is configured to receive a portion of said adhesive and channel a portion of said adhesive between said one or more adhesive channels.

DETAILED DESCRIPTION OF THE INVENTION

Figure 1A:
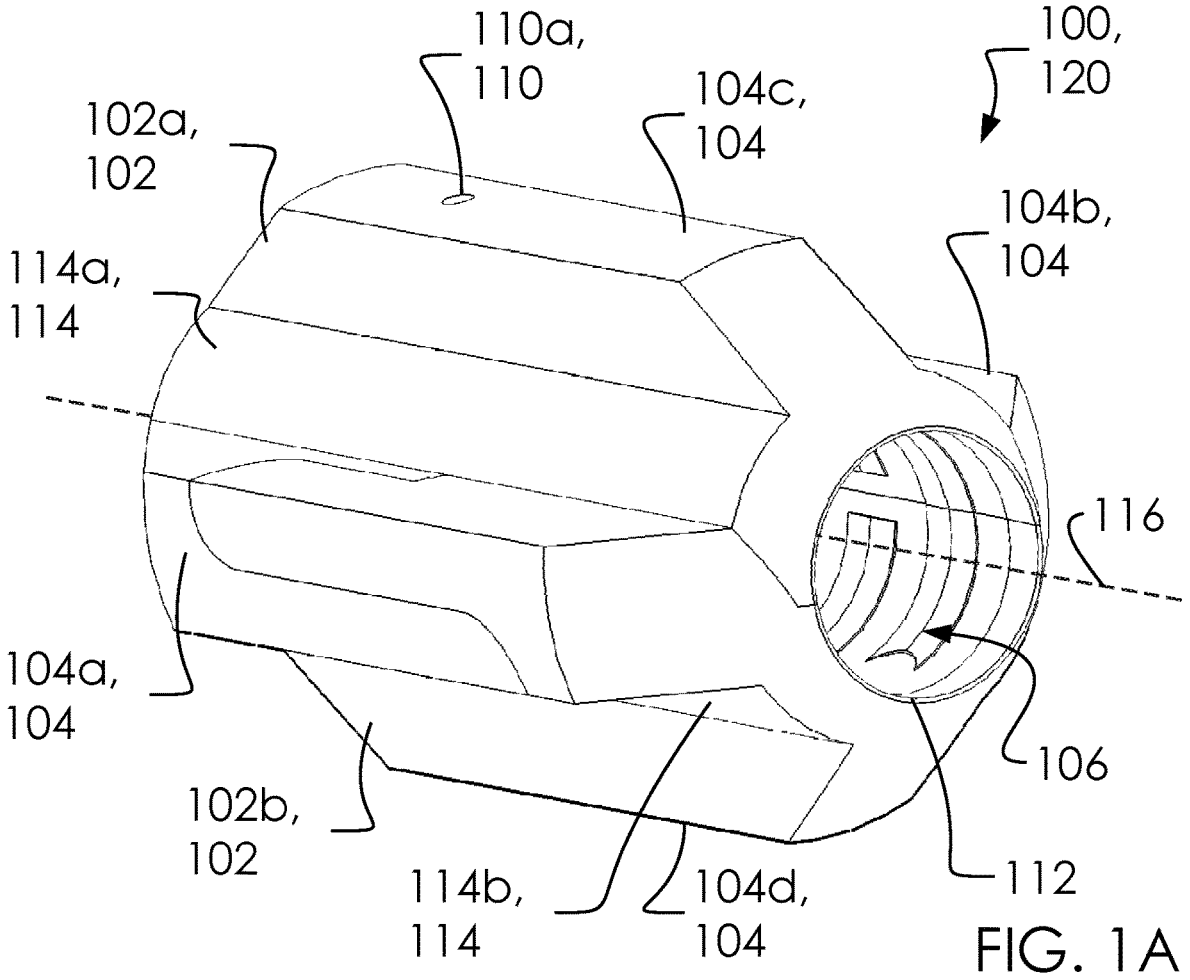
FIG. 1A illustrates a perspective overview view of a molded rod guide 100.

The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

These parts are illustrated in the figures and discussed below:

a molded rod guide 100
a two mating portions 102
a first mating portion 102*a*
a second mating portion 102*b*
a plurality of flutes 104
a first flute 104*a*
a second flute 104*b*
a third flute 104*c*
a fourth flute 104*d*
a center channel 106
a one or more fill ports 110
a first fill port 110*a*
a second fill port 110*b*
a first end 112
a body portion 114
a first body portion 114*a*
a second body portion 114*b*
a center axis 116
an assembled configuration 120 a width 122
a height 124
a radially outward direction 126
a second end 202
a rod 204
a rod surface 206
a side portions 302
a first side 302*a*
a second side 302*b*
a clip portions 304
a first clip 304*a*
a second clip 304*b*
a lower dimples 306
a first lower dimple 306*a*
a second lower dimple 306*b*
an upper dimples 308
a first upper dimple 308*a*
a second upper dimple 308*b*
a one or more lower faces 310
a first lower face 310*a*
a second lower face 310*b*
a one or more upper faces 312
a first upper face 312*a*
a second upper face 312*b*
a one or more concave clip portions 406
a first concave clip portion 406*a*
a second concave clip portion 406*b*
a one or more convex clip portions 408
a first convex clip portion 408*a*
a second convex clip portion 408*b*
a one or more end half mouths 410
a first end half mouth 410*a*
a second end half mouth 410*b*
a first end 502
a second end 504
a clip indention 506
a clip extension 508
a gap 510
a one or more beveled ends 802
a first beveled end 802*a*
a second beveled end 802*b*
an interior surface 804
a one or more adhesive channels 806
a first adhesive channel 806*a*
a second adhesive channel 806*b*
a third adhesive channel 806*c*
a fourth adhesive channel 806*d*
a fifth adhesive channel 806*e*
a sixth adhesive channel 806*f*
a seventh adhesive channel 806*g*
a one or more gaps 808
a first gap 808*a*
a second gap 808*b*
a third gap 808*c*
a fourth gap 808*d*
a body 900
an exterior surface 902
an interior surface 904
a top flute 906
a diameter 908
a diameter 910
a separated configuration 1000
a first end portion 1002
a second end portion 1004
a cavity 1302
an adhesive 1400
a first adhesive 1400*a*
a second adhesive 1400*b*
an adhesive damn 1404
a mechanical interference 1406
a method of use 1600
a start point 1602
a one or more steps 1604
a first step 1604*a*
a second step 1604*b*
an end point 1606
a prior art guide 1700
a one or more surface flutes 1702
a first surface flute 1702*a*
a second surface flute 1702*b*
a third surface flute 1702*c*
a fourth surface flute 1702*d*
a molded rod guide 1800
a two mating portions 1802
a first mating portion 1802*a*
a second mating portion 1802*b*
a one or more flutes 1804
a first flute 1804*a*
a second flute 1804*b*
a third flute 1804*c*
a fourth flute 1804*d*
a center channel 1806
a one or more fill ports 1810
a first fill port 1810*a*
a second fill port 1810*b*
a first end 1812
a one or more body portions 1814
a first body portion 1814*a*
a second body portion 1814*b*
a center axis 1816
a first side 1902*a*
a second side 1902*b*
a one or more clips 1904
a first clip 1904*a*
a second clip 1904*b*
a one or more lower faces 1910
a first lower face 1910*a*
a second lower face 1910*b*
a one or more upper faces 1912
a first upper face 1912*a*
a second upper face 1912*b*
a one or more beveled ends 2002
a first beveled end 2002*a*
a second beveled end 2002*b*
an interior surface 2004
a one or more adhesive channels 2006
a first adhesive channel 2006*a*
a second adhesive channel 2006*b*
a third adhesive channel 2006*c*
a fourth adhesive channel 2006*d*
a fifth adhesive channel 2006*e*
a sixth adhesive channel 2006*f*
a seventh adhesive channel 2006*g*
an eight adhesive channel 2006*h*
a ninth adhesive channel 2006*j*
a tenth adhesive channel 2006*k*
a molded rod guide 2100
a two mating portions 2102
a first mating portion 2102*a*
a second mating portion 2102*b*
a one or more flutes 2104
a first flute 2104*a*
a second flute 2104*b*
a third flute 2104*c* a fourth flute 2104*d*
a center channel 2106
a one or more fill ports 2110
a first fill port 2110*a*
a second fill port 2110*b*
a first end 2112
a one or more body portions 2114
a first body portion 2114*a*
a second body portion 2114*b*
a center axis 2116
an assembled configuration 2120
a second end 2202
a one or more interior surfaces 2302
a first interior surface 2302*a*
a second interior surface 2302*b*
a first side 2304*a*
a second side 2304*b*
a one or more tabs 2306
a first tab 2306*a*
a second tab 2306*b*
a third tab 2306*c*
a one or more slots 2308
a first slot 2308*a*
a second slot 2308*b*
a third slot 2308*c*
a long tab 2310
a long slot 2312
a two half flutes 2402
a first half flute 2402*a*
a second half flute 2402*b*
a one or more clips 2602
a first clip 2602*a*
a second clip 2602*b*
a third clip 2602*c*
a gap 2702
a one or more beveled edges 2704
a first beveled edge 2704*a*
a second beveled edge 2704*b*

FIG. 1A illustrates a perspective overview view of a molded rod guide 100.

Figure 1B:
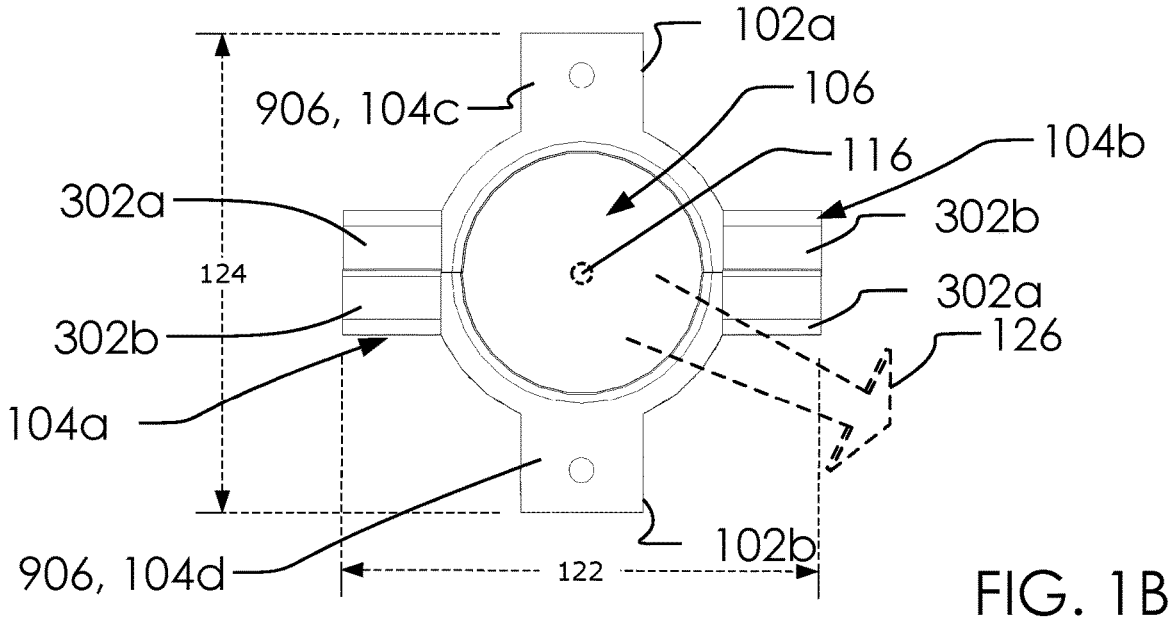
FIG. 1B illustrates an elevated front side view of a molded rod guide 100.

FIG. 1B illustrates an elevated front side view of a molded rod guide 100.

In one embodiment, said molded rod guide 100 can comprise said two mating portions 102, said plurality of flutes 104, said center channel 106, said one or more fill ports 110, said first end 112, said body portion 114, said center axis 116, said width 122, said height 124 and said radially outward direction 126.

In one embodiment, said two mating portions 102 can comprise said first mating portion 102*a* and said second mating portion 102*b*.

In one embodiment, said one or more fill ports 110 can comprise said first fill port 110*a* and said second fill port 110*b*.

In one embodiment, said plurality of flutes 104 can comprise said first flute 104*a*, said second flute 104*b*, said third flute 104*c* and said fourth flute 104*d*.

In one embodiment, said body portion 114 can comprise said first body portion 114*a* and said second body portion 114*b*.

In one embodiment, said molded rod guide 100 can be assembled by aligning and snapping said two mating portions 102 to one another, as discussed herein.

Said center channel 106 can receive a rod, as is known in the art. Said plurality of flutes 104 can be located in part or whole on each of said two mating portions 102. For example, said third flute 104*c* can be on said first mating portion 102*a* and said fourth flute 104*d* can be on said second mating portion 102*b*; and said first flute 104*a* and said second flute 104*b* can be made up partially of each among said two mating portions 102, as illustrated. It is not mandatory that said two mating portions 102 mate with one another across said plurality of flutes 104. It is plausible that said two mating portions 102 would mate with one another in said body portion 114.

When assembled, said molded rod guide 100 can comprise a substantially cylindrical body (said body portion 114) aligned among said center axis 116; wherein, said plurality of flutes 104 extend outward away from said body portion 114 substantially perpendicular from said body portion 114, as illustrated.

In one embodiment, said center channel 106 can be aligned with said center axis 116.

In one embodiment, said one or more fill ports 110 can be apertures in portions of each among said two mating portions 102. For example, as illustrated, said one or more fill ports 110 can be cut into said plurality of flutes 104. Specifically, said first fill port 110*a* can be in said third flute 104*c* and said second fill port 110*b* can be in said fourth flute 104*d* (not illustrated here).

Materials for rod sucker guides (such as said molded rod guide 100) are well-known in the art. Here, said molded rod guide 100 can comprise a fiberglass impregnated plastic.

Figure 2:
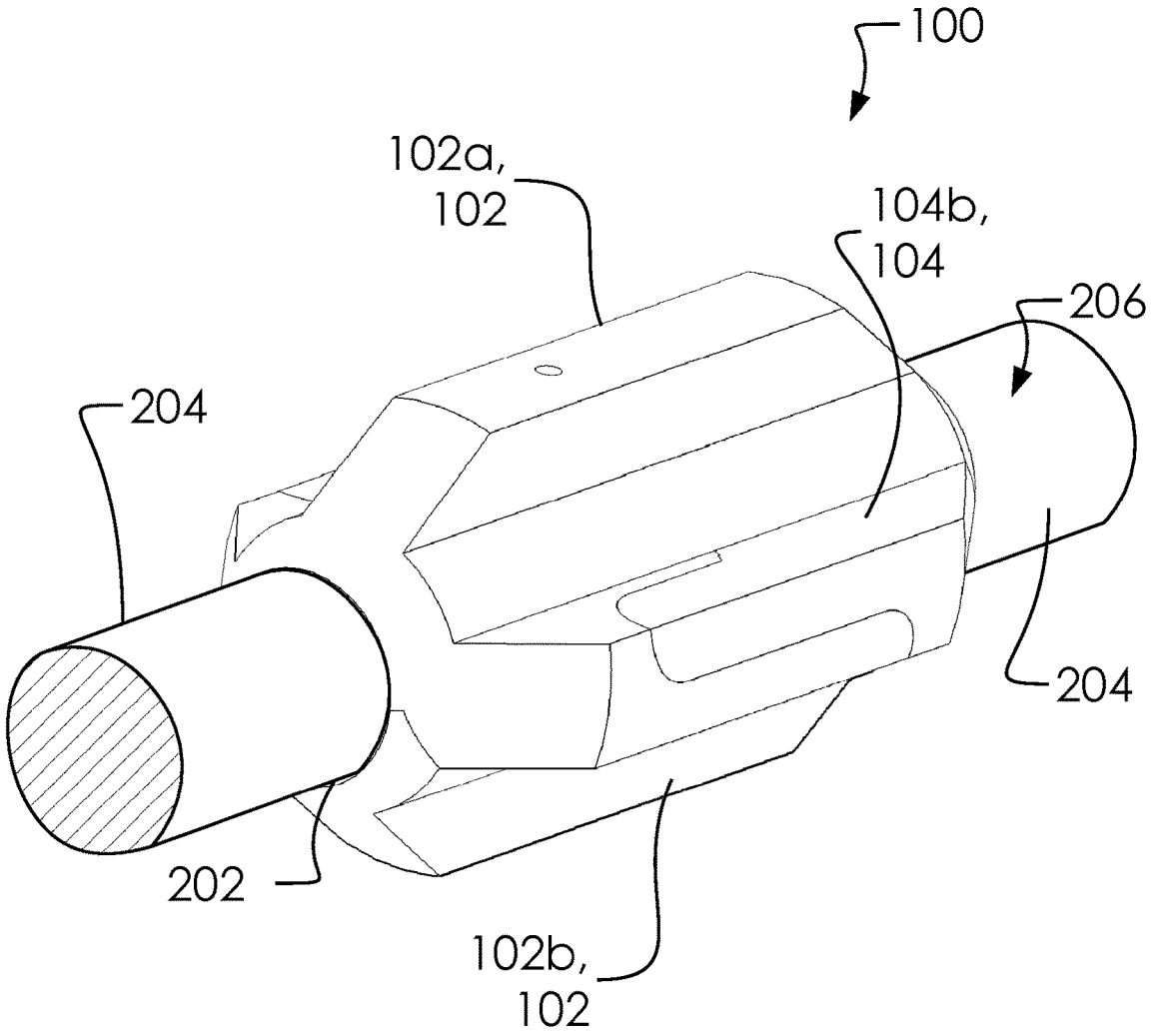
FIG. 2 illustrates a perspective second side view of a molded rod guide 100 with said rod 204 in cross-section.

FIG. 2 illustrates a perspective second side view of a molded rod guide 100 with said rod 204 in cross-section.

In one embodiment, said rod 204 can comprise said rod surface 206.

In one embodiment, said molded rod guide 100 can comprise said second end 202.

In one embodiment, said molded rod guide 100 can attach around said rod 204 by aligning each among said two mating portions 102 around said rod 204 of said second end 202, snapping said two mating portions 102 together, and affixing said molded rod guide 100 with said rod 204 with friction or adhesive or both.

As is known in the art, said molded rod guide 100 can protect said rod 204 from friction; wherein, plurality of flutes 104 can comprise wear items, designed for protection of said rod 204 and other well equipment.

Figure 3:
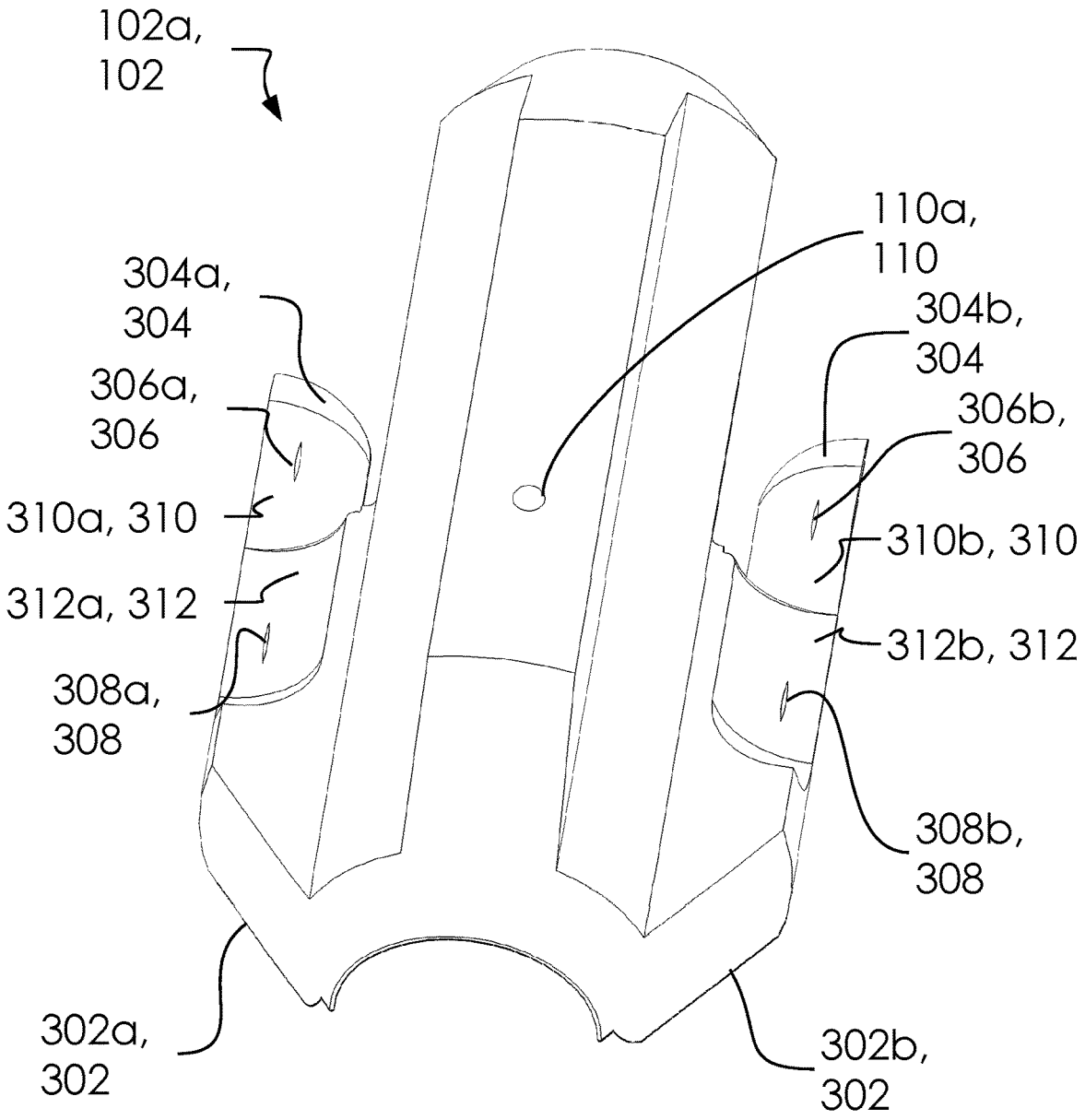
FIG. 3 illustrates a perspective overview view of a first mating portion 102*a*.

FIG. 3 illustrates a perspective overview view of a first mating portion 102*a*.

In one embodiment, said clip portions 304 can comprise said first clip 304*a*, said second clip 304*b*, said lower dimples 306, said upper dimples 308, said one or more lower faces 310 and said one or more upper faces 312.

In one embodiment, said lower dimples 306 can comprise said first lower dimple 306*a* and said second lower dimple 306*b*.

In one embodiment, said upper dimples 308 can comprise said first upper dimple 308*a* and said second upper dimple 308*b*.

In one embodiment, said one or more lower faces 310 can comprise said first lower face 310*a* and said second lower face 310*b*.

In one embodiment, said one or more upper faces 312 can comprise said first upper face 312*a* and said second upper face 312*b*.

In one embodiment, said side portions 302 can comprise said first side 302*a* and said second side 302*b*.

In one embodiment, said molded rod guide 100 can comprise said side portions 302.

In one embodiment, said two mating portions 102 can comprise said first side 302*a*, said second side 302*b*, said clip portions 304, said lower dimples 306 and said upper dimples 308.

In one embodiment, said first mating portion 102*a* can comprise said second side 302*b*.

In one embodiment, said one or more fill ports 110 can be located roughly half way between said first end 112 and said second end 202; wherein, an adhesive can fill said center channel 106 more evenly due to the location of said one or more fill ports 110.

Said clip portions 304 can be roughly at said first side 302*a* and said second side 302*b* of said two mating portions 102, as illustrated; wherein, each among said clip portions 304 comprise roughly half the mass of one among said plurality of flutes 104.

Each of said clip portions 304 are configured to nest into and attach to another of said clip portions 304 when said first mating portion 102*a* and said second mating portion 102*b* are attached to one another. Said two mating portions 102 are configured to snap into one another by: aligning said first clip 304*a* of said first mating portion 102*a* with said second clip 304*b* of said second clip 304*b* (not illustrated here), sliding said clip portions 304 into one another, and hooking a portion of said first clip 304*a* of said first mating portion 102*a* with a portion of said second clip 304*b* of said second mating portion 102*b*.

Using said first clip 304*a* as an example, said clip portions 304 can comprise said first lower dimple 306*a* and said first upper dimple 308*a* which comprise inverted faces configured for snapping into one another. Likewise, said one or more lower faces 310 can comprise a convex surface and said one or more upper faces 312 can comprise a concave surface.

In one embodiment, lower dimples 306 and upper dimples 308 can comprise small round or elongated portions of one or more lower faces 310 and one or more upper faces 312. In one embodiment, one or more lower faces 310 can be convex and one or more upper faces 312 can be concave; wherein, one or more lower faces 310 and one or more upper faces 312 are designed to mate with one another when first mating portion 102*a* and second mating portion 102*b* are inverted relative to one another and attached, as in assembled configuration 120.

In one embodiment, where one or more lower faces 310 is convex, said lower dimples 306 can be concave; and where one or more upper faces 312 is concave, said upper dimples 308 can be convex. Accordingly, lower dimples 306 and upper dimples 308 can be designed to snap into one another with two mating portions 102 in assembled configuration 120.

Figure 4:
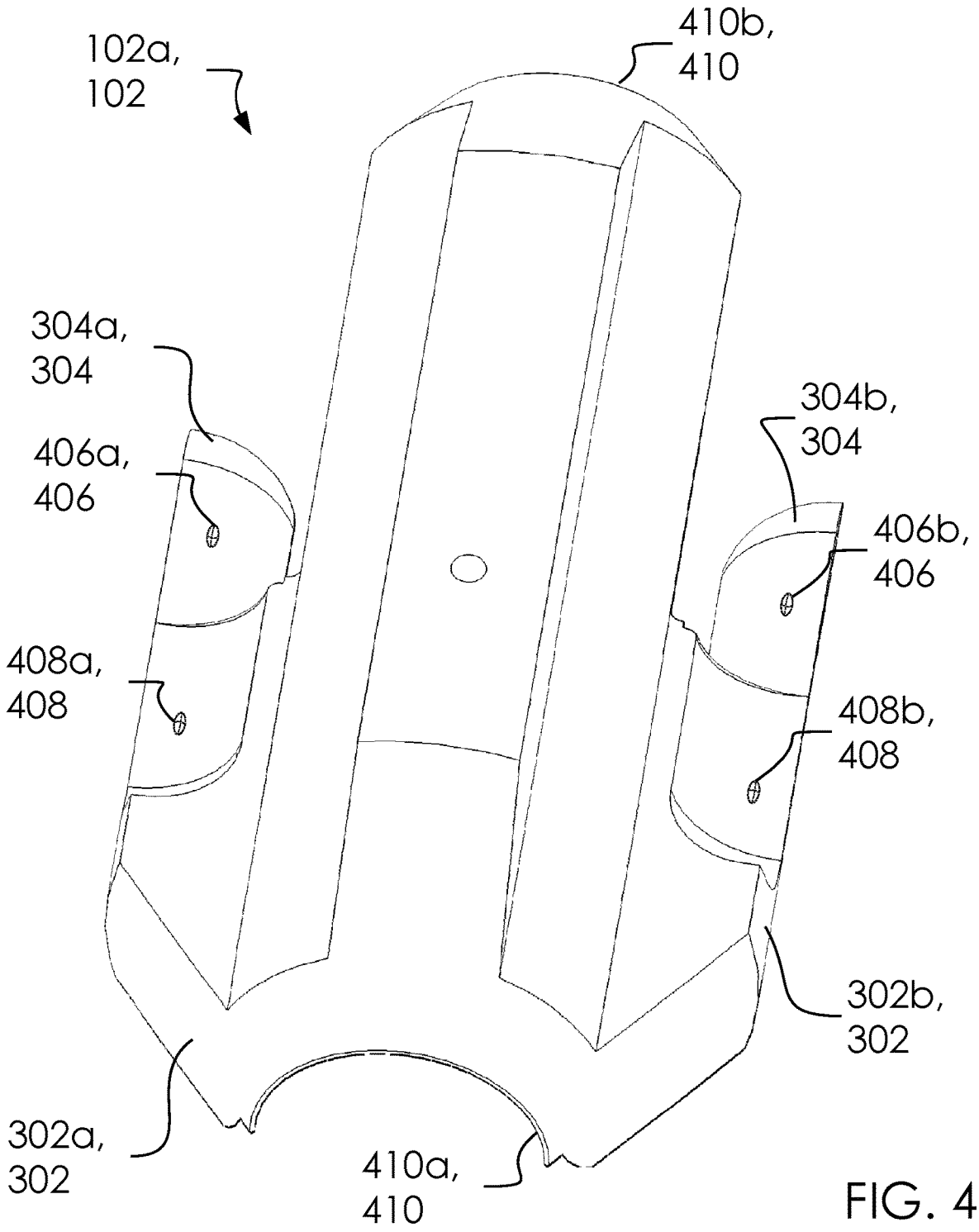
FIG. 4 illustrates a perspective overview view of a first mating portion 102*a*.

FIG. 4 illustrates a perspective overview view of a first mating portion 102*a*.

In one embodiment, said one or more concave clip portions 406 can comprise said first concave clip portion 406*a* and said second concave clip portion 406*b*.

In one embodiment, said one or more convex clip portions 408 can comprise said first convex clip portion 408*a* and said second convex clip portion 408*b*.

In one embodiment, said one or more end half mouths 410 can comprise said first end half mouth 410*a* and said second end half mouth 410*b*.

In one embodiment, said molded rod guide 100 can comprise said one or more end half mouths 410.

In one embodiment, said two mating portions 102 can comprise said one or more end half mouths 410.

In one embodiment, said first mating portion 102*a* can comprise said one or more end half mouths 410, said first end half mouth 410*a* and said second end half mouth 410*b*.

In one embodiment, said first side 302*a* can comprise said second convex clip portion 408*b*.

In one embodiment, said lower dimples 306 and said upper dimples 308 can be more rounded than illustrated in FIG. 3. Herein, said one or more concave clip portions 406 and said one or more convex clip portions 408 comprise substantially rounded portions being convex and concave where noted.

In one embodiment, said center channel 106 can comprise a substantially cylindrical channel in said molded rod guide 100 being aligned with said center axis 116. In one embodiment, said center channel 106 can be cut lengthwise along said center axis 116, as illustrated; wherein, said center channel 106 can comprise said one or more end half mouths 410 at either end of said two mating portions 102. Such that when pressed into one another, said one or more end half mouths 410 comprise a round shape serving as a mouth to be wrapped around said rod 204, as illustrated above.

Figure 5:
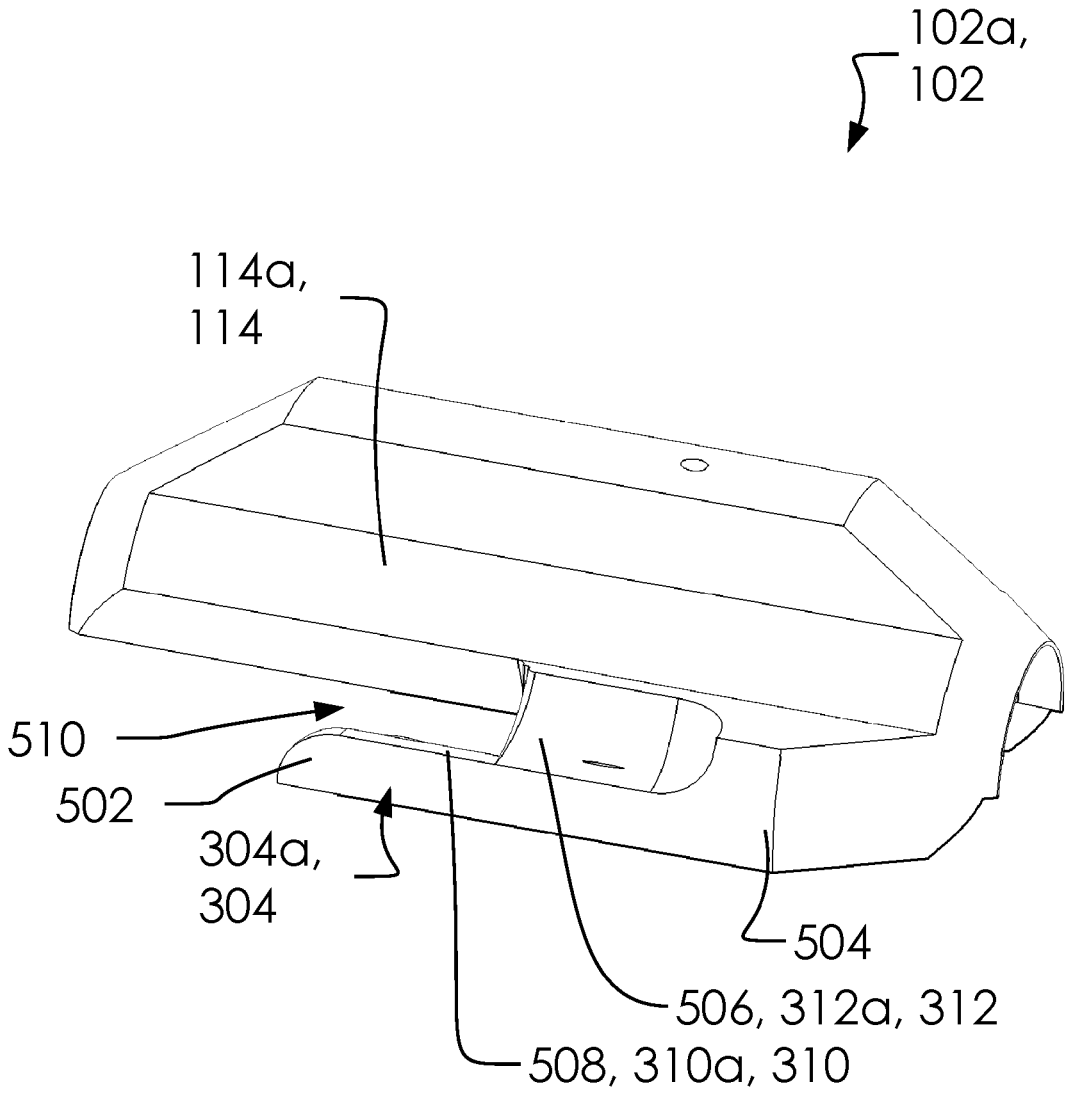
FIG. 5 illustrates a perspective first side view of a first mating portion 102*a*.

FIG. 5 illustrates a perspective first side view of a first mating portion 102*a*.

In one embodiment, said clip portions 304 can comprise said first end 502, said second end 504, said clip indention 506 and said clip extension 508.

In one embodiment, said one or more lower faces 310 can comprise said clip extension 508.

In one embodiment, said one or more upper faces 312 can comprise said clip indention 506.

As noted above and illustrated here, said one or more lower faces 310 can comprise a convex surface and said one or more upper faces 312 can comprise a concave surface.

In one embodiment, said first end 502 can extend out away from said body portion 114 leaving said gap 510 between said 114 and said clip portions 304, as illustrated. Wherein, with said two mating portions 102 in said molded rod guide 100 in said assembled configuration 120, a portion of said first mating portion 102*a* fits into said gap 510.

Figure 6:
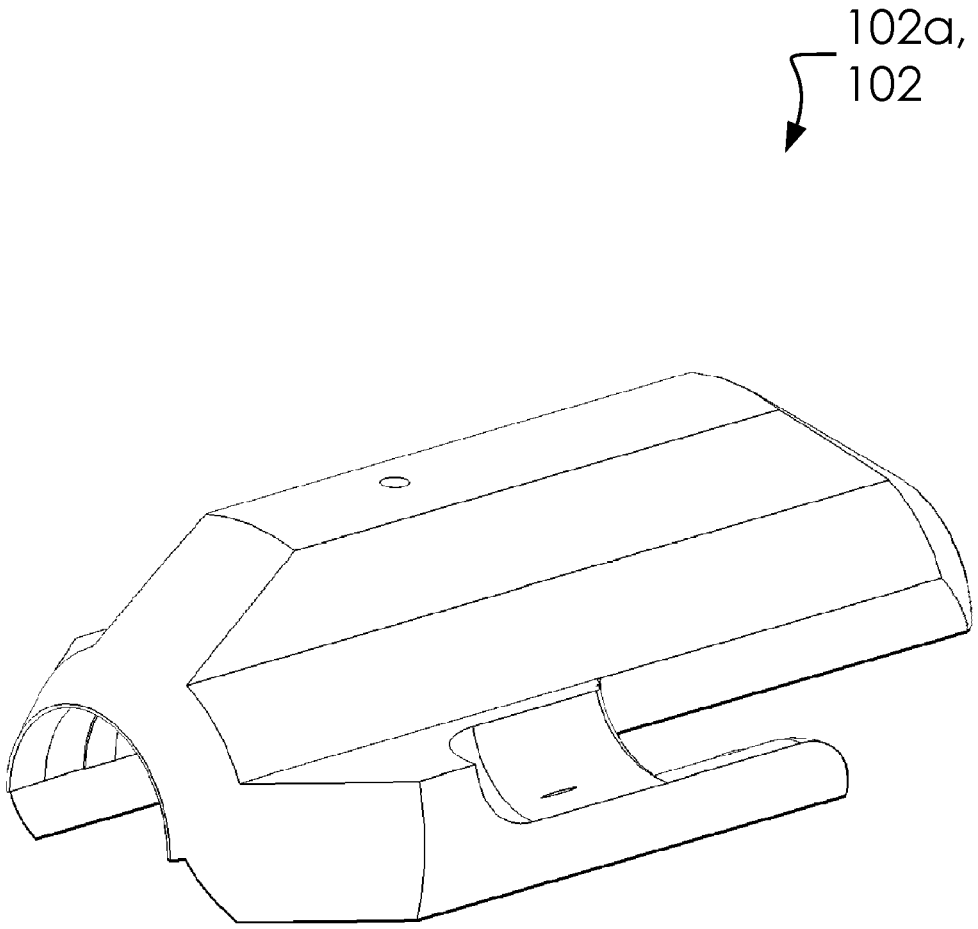
FIG. 6 illustrates a perspective second side view of a first mating portion 102*a*.

FIG. 6 illustrates a perspective second side view of a first mating portion 102*a*.

Figure 7A:
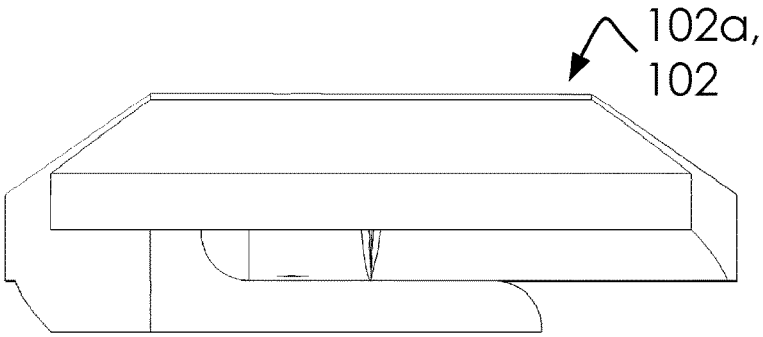
FIG. 7A illustrates an elevated second side view of a first mating portion 102*a*.

FIG. 7A illustrates an elevated second side view of a first mating portion 102*a*.

Figure 7D:
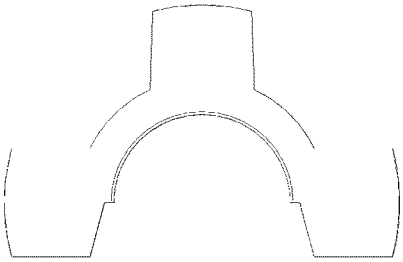
FIG. 7D illustrates an elevated front side view of a first mating portion 102*a*.
Figure 7B:
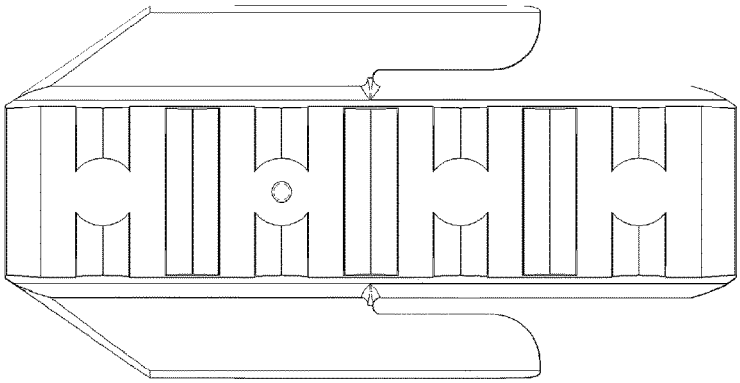
FIG. 7B illustrates an elevated bottom side view of a first mating portion 102*a*.

FIG. 7B illustrates an elevated bottom side view of a first mating portion 102*a*.

Figure 7C:
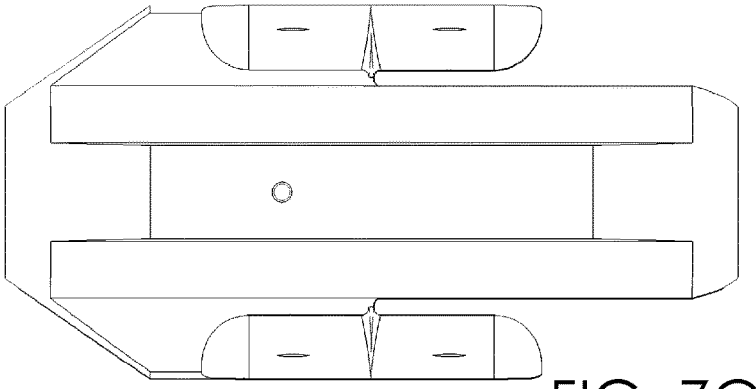
FIG. 7C illustrates an elevated top side view of a first mating portion 102*a*.

FIG. 7C illustrates an elevated top side view of a first mating portion 102*a*.

FIG. 7D illustrates an elevated front side view of a first mating portion 102*a*.

Figure 8A:
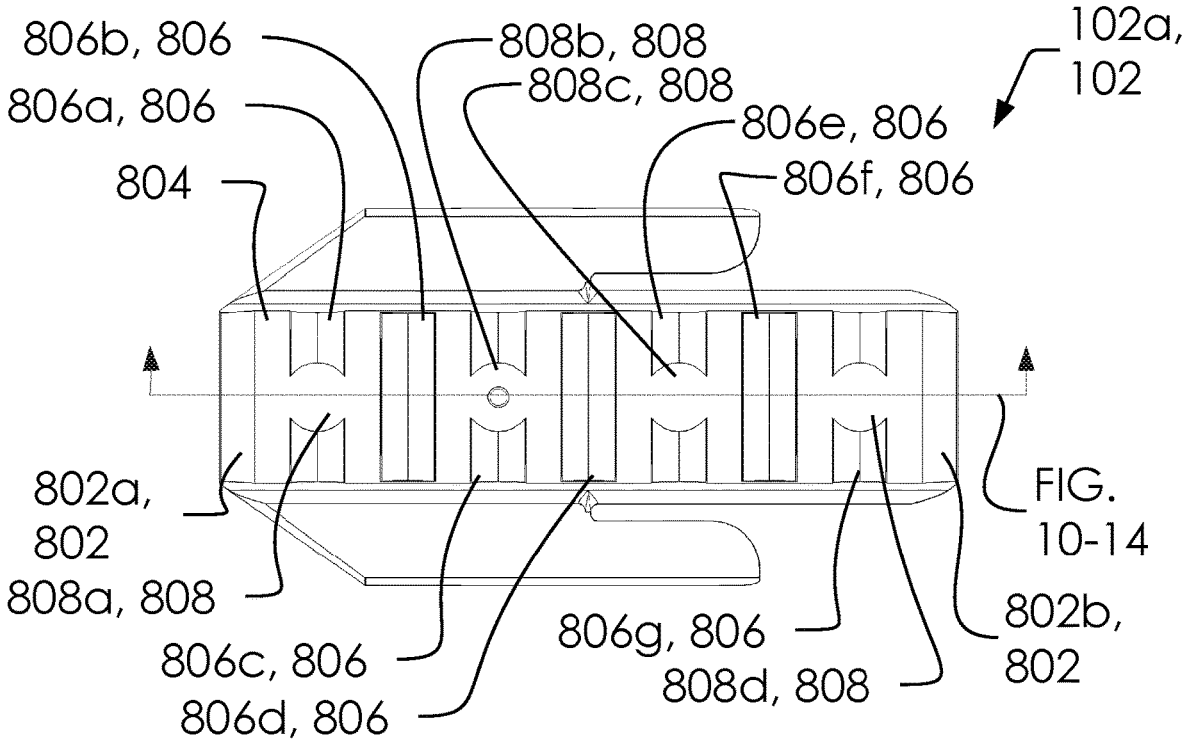
FIG. 8A illustrates an elevated bottom side view of a first mating portion 102*a*.

FIG. 8A illustrates an elevated bottom side view of a first mating portion 102*a*.

Figures 8B, 8C:
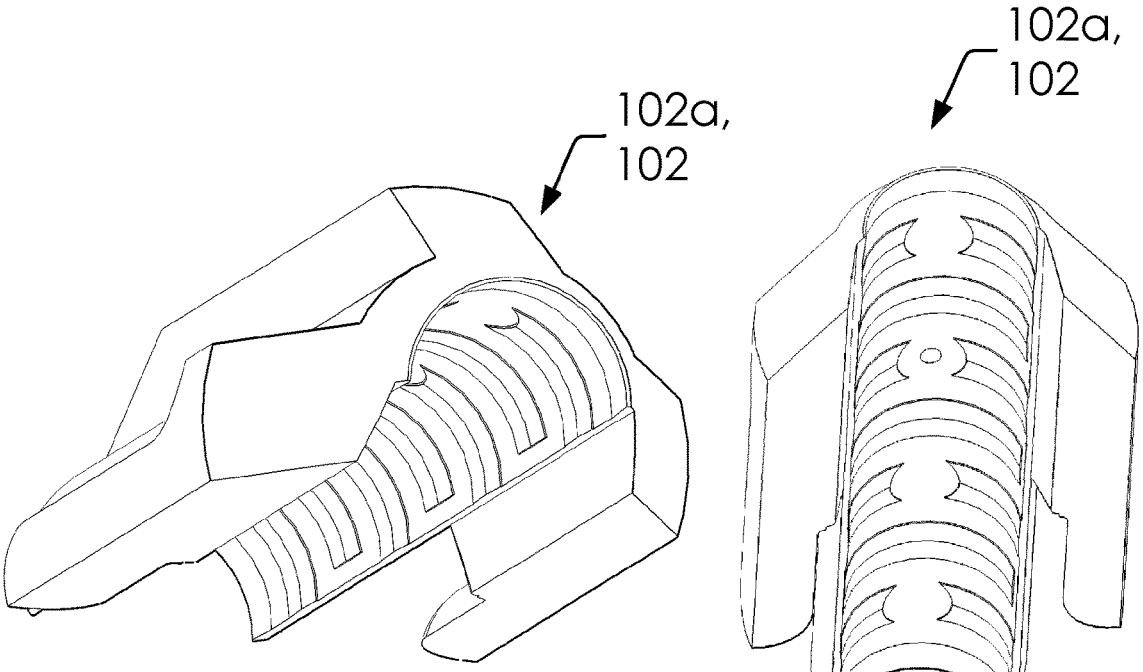
FIG. 8B illustrates a perspective bottom side view of a first mating portion 102*a*.
FIG. 8C illustrates a perspective bottom side view of a first mating portion 102*a*.

FIG. 8B illustrates a perspective bottom side view of a first mating portion 102*a*.

FIG. 8C illustrates a perspective bottom side view of a first mating portion 102*a*.

In one embodiment, said one or more beveled ends 802 can comprise said first beveled end 802*a* and said second beveled end 802*b*.

In one embodiment, said interior surface 804 can comprise said one or more beveled ends 802, said one or more adhesive channels 806 and said one or more gaps 808.

In one embodiment, said one or more adhesive channels 806 can comprise said first adhesive channel 806*a*, said second adhesive channel 806*b*, said third adhesive channel 806*c*, said fourth adhesive channel 806*d*, said fifth adhesive channel 806*e*, said sixth adhesive channel 806*f* and said seventh adhesive channel 806*g*.

In one embodiment, said one or more gaps 808 can comprise said first gap 808*a*, said second gap 808*b*, said third gap 808*c* and said fourth gap 808*d*.

In one embodiment, said two mating portions 102 can comprise said interior surface 804 and said seventh adhesive channel 806*g*.

Said one or more adhesive channels 806 can comprise ribs or channels for directing an adhesive between said two mating portions 102 and said 204; further, to provide friction within said center channel 106.

Said one or more gaps 808 comprise gaps in said one or more adhesive channels 806 which can allow said adhesive (discussed below) to pass between said one or more adhesive channels 806. In one embodiment, said one or more fill ports 110 can be configured to penetrate said body portion 114 and/or said plurality of flutes 104 at one of said one or more gaps 808 (such as said second gap 808*b*, as illustrated).

A cut line is shown on FIG. 8A to indicate a location for a cross-section in FIGS. 10-14.

Figure 9:
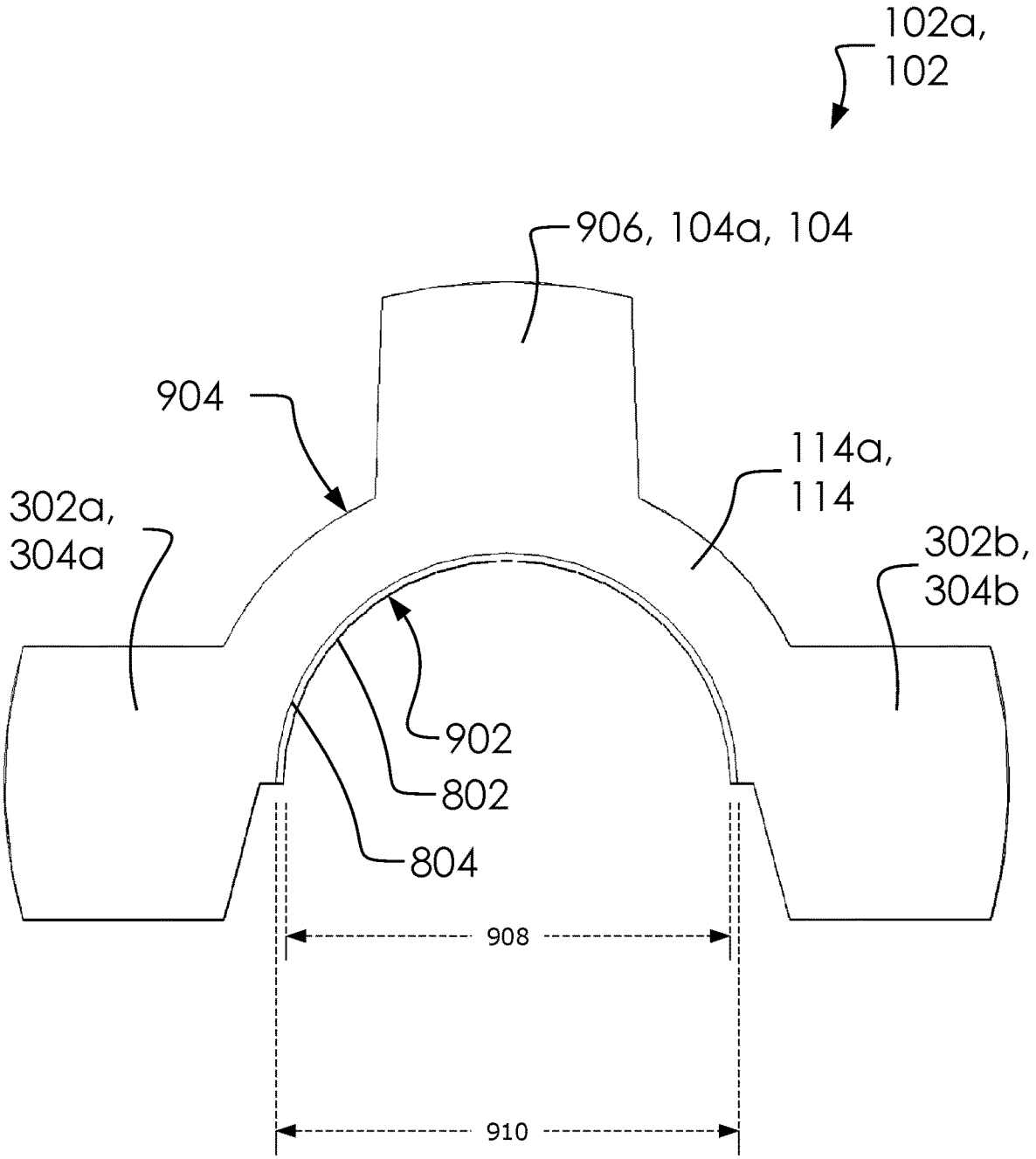
FIG. 9 illustrates an elevated front side view of a first mating portion 102*a*.

FIG. 9 illustrates an elevated front side view of a first mating portion 102*a*.

In one embodiment, said body 900 can comprise said exterior surface 902 and said interior surface 904.

In one embodiment, said molded rod guide 100 can comprise said body 900.

In one embodiment, said two mating portions 102 can comprise said body 900.

In one embodiment, said one or more beveled ends 802 can comprise said diameter 908.

In one embodiment, said interior surface 804 can comprise said diameter 910.

In one embodiment, said first body portion 114*a* can comprise said exterior surface 902 and said interior surface 904.

In one embodiment, said side portions 302 can comprise said top flute 906.

Said body portion 114 being generally the connecting portions around said center channel 106 and between said plurality of flutes 104.

Said body 900 can comprise a semi-circle or a half circle since said center channel 106 can comprise a half pipe being cut through said molded rod guide 100 and cut in half to form said two mating portions 102.

Said exterior surface 902 can comprise a surface within said center channel 106 and comprising said one or more adhesive channels 806 and said one or more gaps 808.

Said interior surface 904 can comprise a substantially cylindrical shape with said plurality of flutes 104 pressing out at equivalent radial measurements. For example, as illustrated, where said plurality of flutes 104 comprise four parts, said plurality of flutes 104 are 90 degrees separated along said interior surface 904. Or, more specifically, since said two mating portions 102 are cut lengthwise through said center channel 106, each of said two mating portions 102 can comprise portions of three of plurality of flutes 104.

Figure 10:
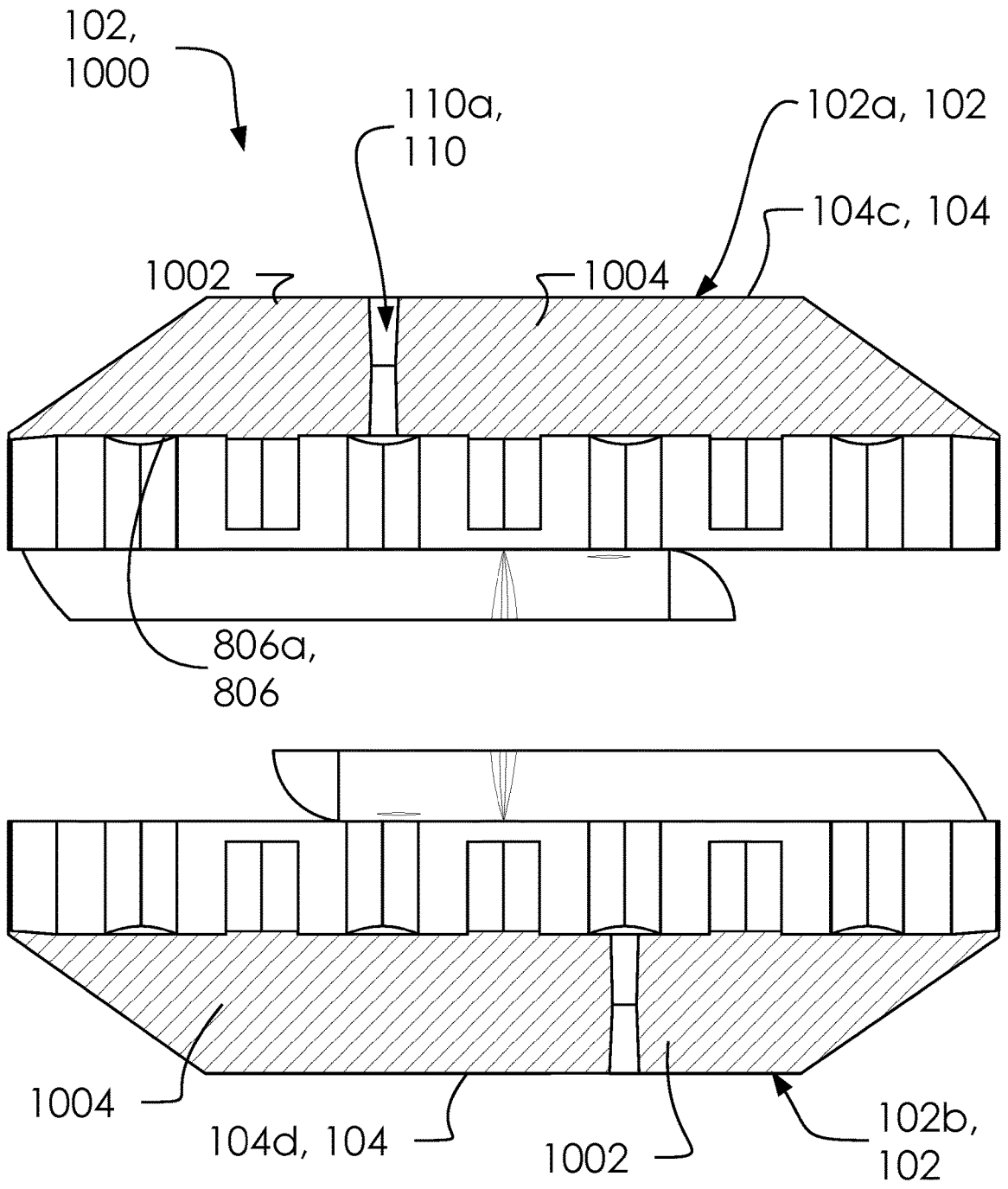
FIG. 10 illustrates an elevated front side view of a two mating portions 102 separated and in cross-section.

FIG. 10 illustrates an elevated front side view of a two mating portions 102 separated and in cross-section.

In one embodiment, said molded rod guide 100 can comprise said first end portion 1002 and said second end portion 1004.

In one embodiment, said third flute 104*c* can comprise said first end portion 1002 and said second end portion 1004.

In one embodiment, said fourth flute 104*d* can comprise said first end portion 1002 and said second end portion 1004.

Said separated configuration 1000 can comprise said two mating portions 102 being unconnected with one another.

Said one or more adhesive channels 806 can comprise a depth extending them into said center channel 106 so as to press into a portion of said rod 204.

In one embodiment, said first end portion 1002 and said second end portion 1004 can be separated by said one or more fill ports 110, as illustrated.

In one embodiment, said one or more fill ports 110 can be substantially in a central portion of said two mating portions 102 so as to ensure that an adhesive fills portions of said center channel 106 without hindrance.

Figure 11:
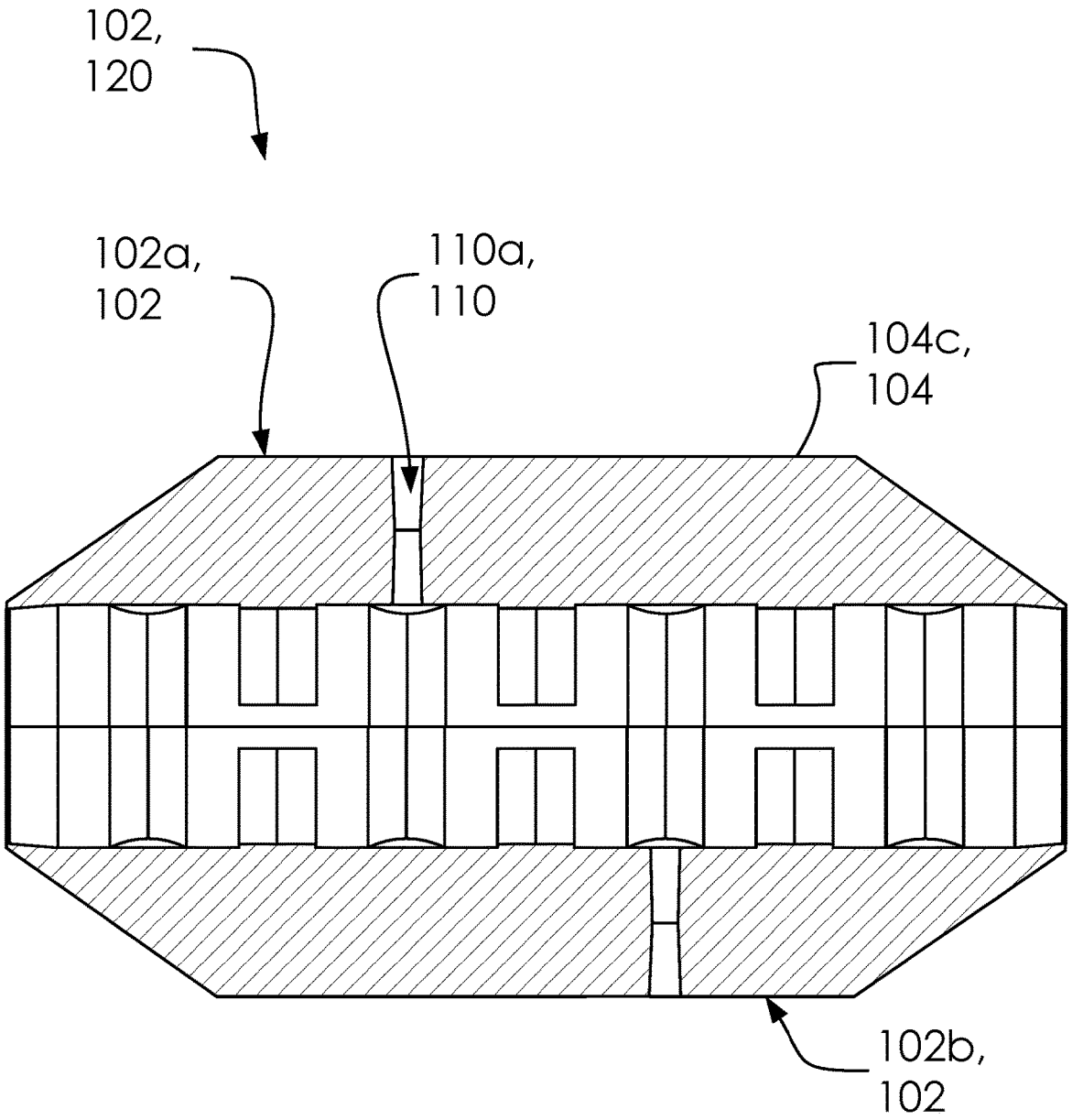
FIG. 11 illustrates an elevated front side view of a two mating portions 102 in cross-section.

FIG. 11 illustrates an elevated front side view of a two mating portions 102 in cross-section.

In one embodiment, said first fill port 110*a* and said second fill port 110*b* are not exactly aligned with said two mating portions 102 aligned, as illustrated, consequently, said center channel 106 does not fill at similar locations with adhesive (as discussed below).

Figure 12:
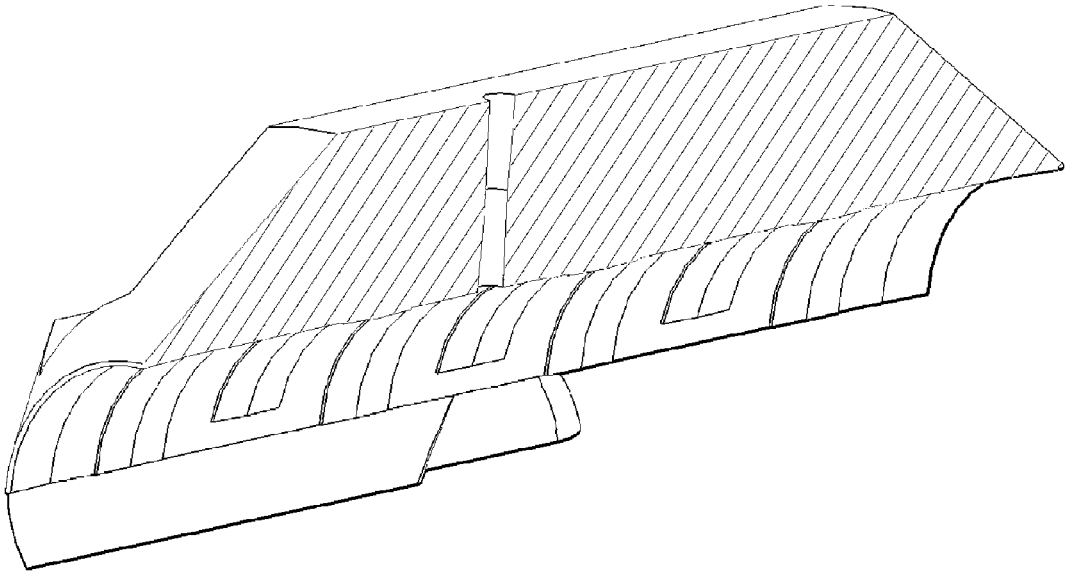
FIG. 12 illustrates a perspective front side view of a first mating portion 102*a* in cross-section.

FIG. 12 illustrates a perspective front side view of a first mating portion 102*a* in cross-section.

Figure 13:
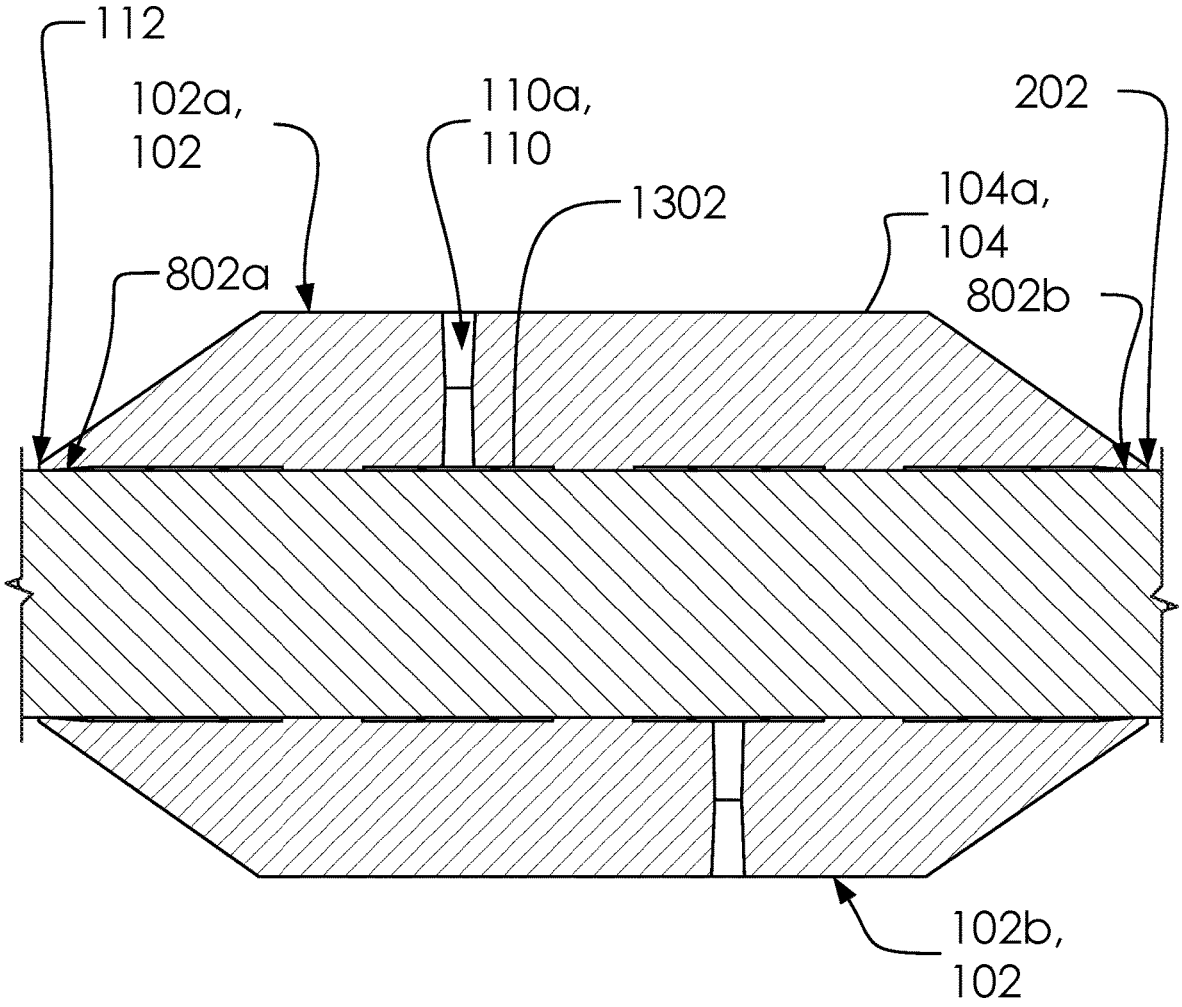
FIG. 13 illustrates an elevated front side view of a molded rod guide 100 in cross-section with said rod 204.

FIG. 13 illustrates an elevated front side view of a molded rod guide 100 in cross-section with said rod 204.

In one embodiment, said molded rod guide 100 can comprise said cavity 1302.

With said molded rod guide 100 affixed to said rod 204 a cavity 1302 is formed.

In one embodiment, said one or more beveled ends 802 can press down on portions of said rod surface 206 of said rod 204 so as to seal in said adhesive and hold said molded rod guide 100 on said rod 204 by a friction.

In one embodiment, said first beveled end 802*a* can be at said first end 112 and said second beveled end 802*b* can be at said second end 202.

Figure 14:
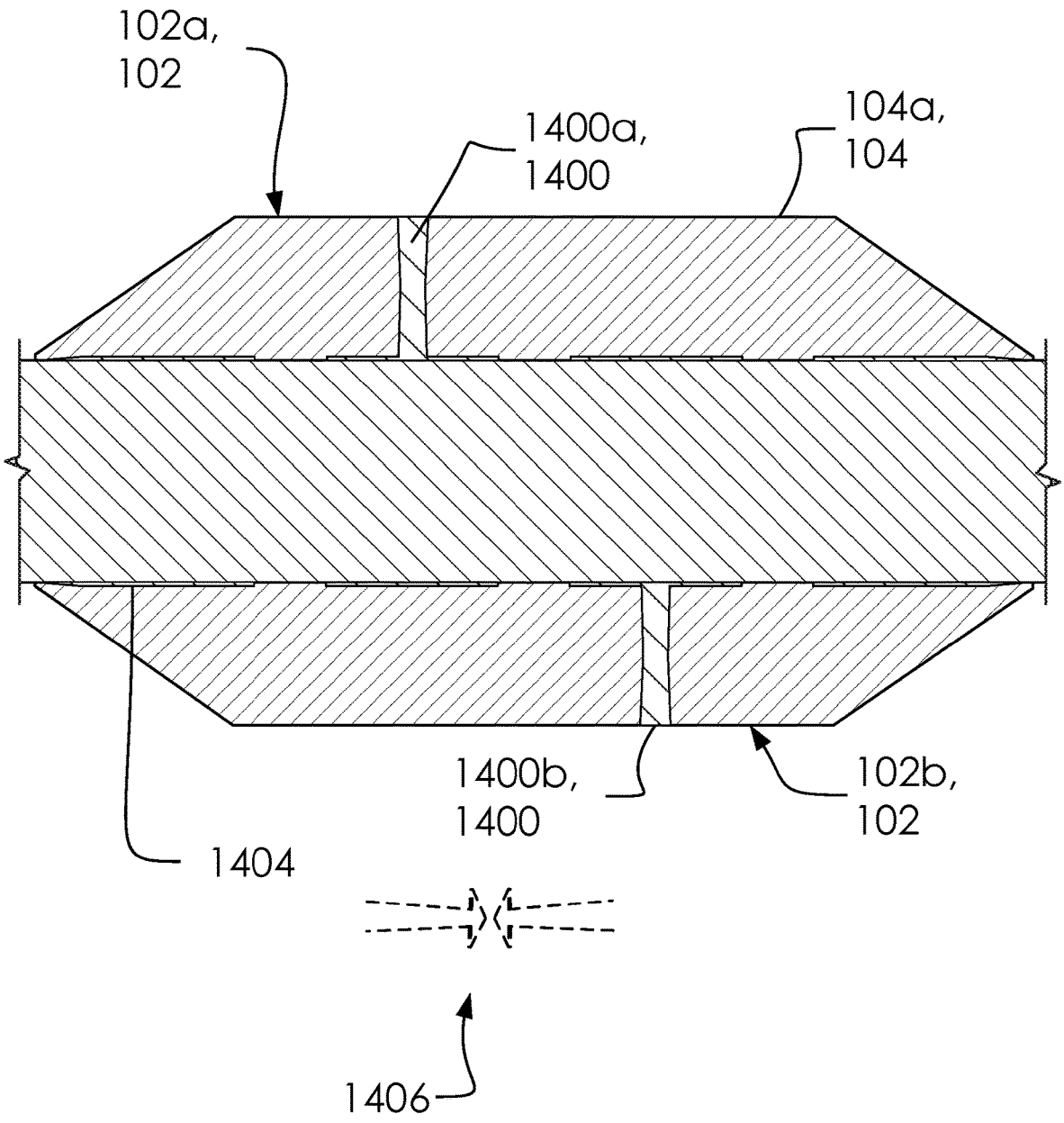
FIG. 14 illustrates an elevated front side view of a molded rod guide 100 in cross-section and with said rod 204.

FIG. 14 illustrates an elevated front side view of a molded rod guide 100 in cross-section and with said rod 204.

In one embodiment, said adhesive 1400 can comprise said first adhesive 1400*a* and said second adhesive 1400*b*.

Said adhesive 1400 can comprise an adhesive, as is known in the art, such as a single part, multi-part and/or heat cure. In one embodiment, said adhesive 1400 can comprise an epoxy.

The cavity 1302 can be designed to create a geometric feature (wedges, holes, groves, ribs, etc.) with the bonding agent/filler material. The independent pieces have one or more fill ports 110 to allow for bonding agent filler to be forced/pulled into the cavity 1302. The bonding agent/filler chemically bonds to the surface of said rod 204. The bonding agent/filler could be of single part or multi part adhesive and may or may not need curing.

In one embodiment, said adhesive 1400 can provide said mechanical interference 1406 by providing said adhesive damn 1404 between molded rod guide 100 and rod 204.

In one embodiment, said adhesive 1400 can be configured to bond primarily with either molded rod guide 100 and/or rod 204; wherein, molded rod guide 100 can be configured to adhere to rod 204; further wherein, adhesive damn 1404 can provide mechanical interference 1406 between rod 204 and molded rod guide 100 by blocking portions of one or more adhesive channels 806 and/or one or more beveled ends 802.

Figure 15:
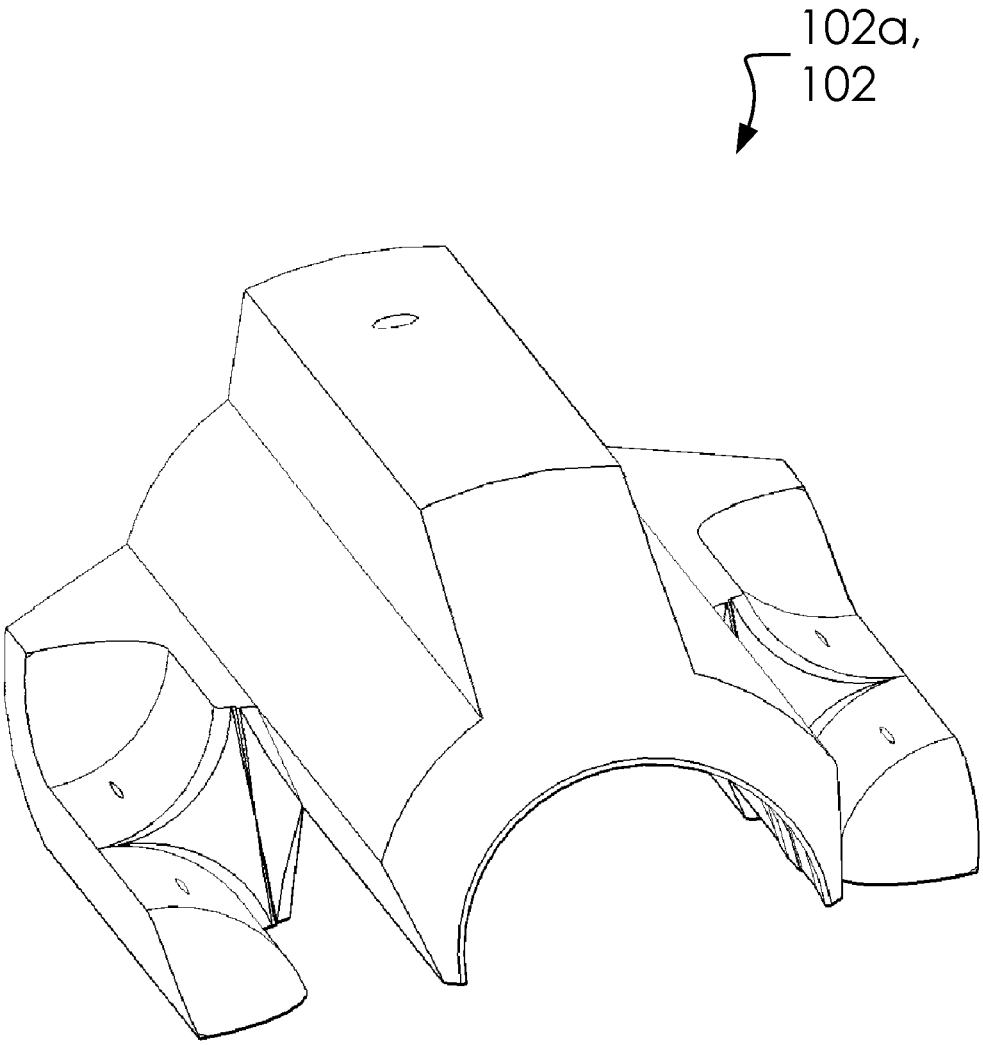
FIG. 15 illustrates a perspective back side view of a first mating portion 102*a*.

FIG. 15 illustrates a perspective back side view of a first mating portion 102*a*.

Figure 16:
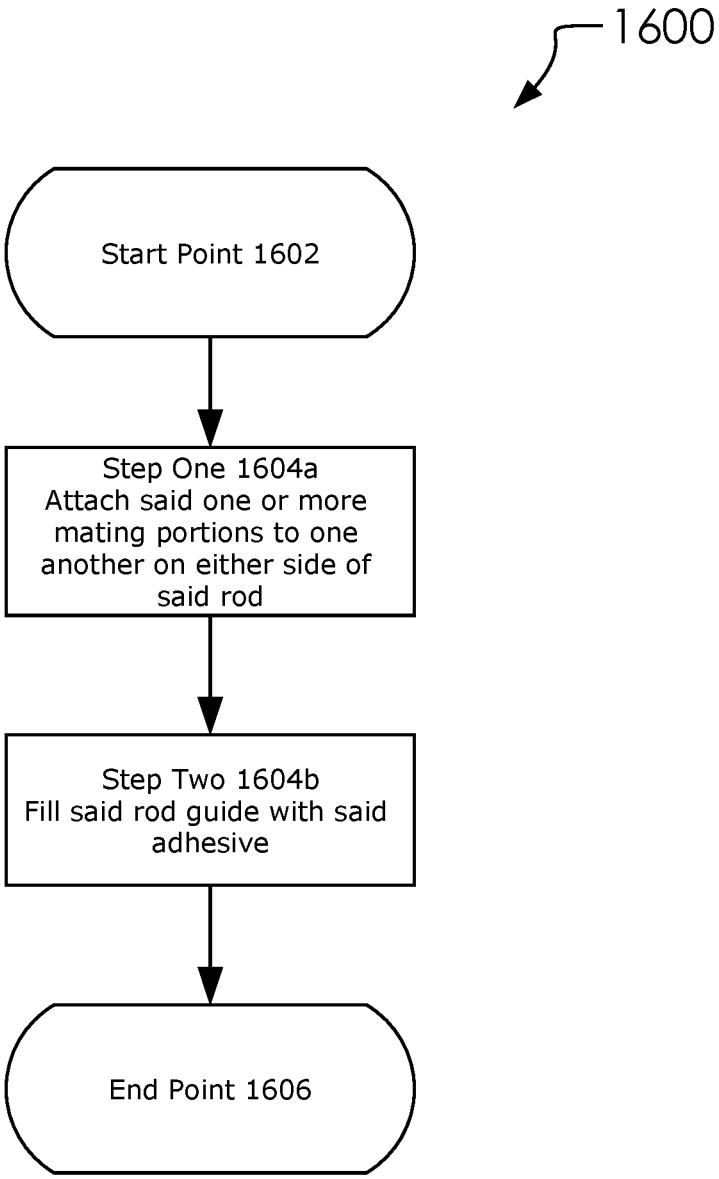
FIG. 16 illustrates a flow chart view of a method of use 1600.

FIG. 16 illustrates a flow chart view of a method of use 1600.

In one embodiment, said method of use 1600 can comprise said start point 1602, said one or more steps 1604 and said end point 1606.

In one embodiment, said one or more steps 1604 can comprise said first step 1604*a* and said second step 1604*b*.

Said method of use 1600 can comprise a significant improvement over the prior art; wherein, the rod guide had to be rotated on without adhesive and lock into place without adhesives. The step of removing the entire rod could slow down a turn around by 2-3 weeks in many cases.

Whereas, with said molded rod guide 100, the user merely attaches, adds adhesive and starts using once the adhesive is cured. This means that a true and sturdy field install is now possible.

Said start point 1602 can comprise a starting point. Said first step 1604*a* can comprise attaching said two mating portions 102 to one another around said rod 204. Said second step 1604*b* can comprise filling said one or more fill ports 110 with said adhesive 1400. Said end point 1606 can comprise an end point to said method of use 1600.

Figure 17A:
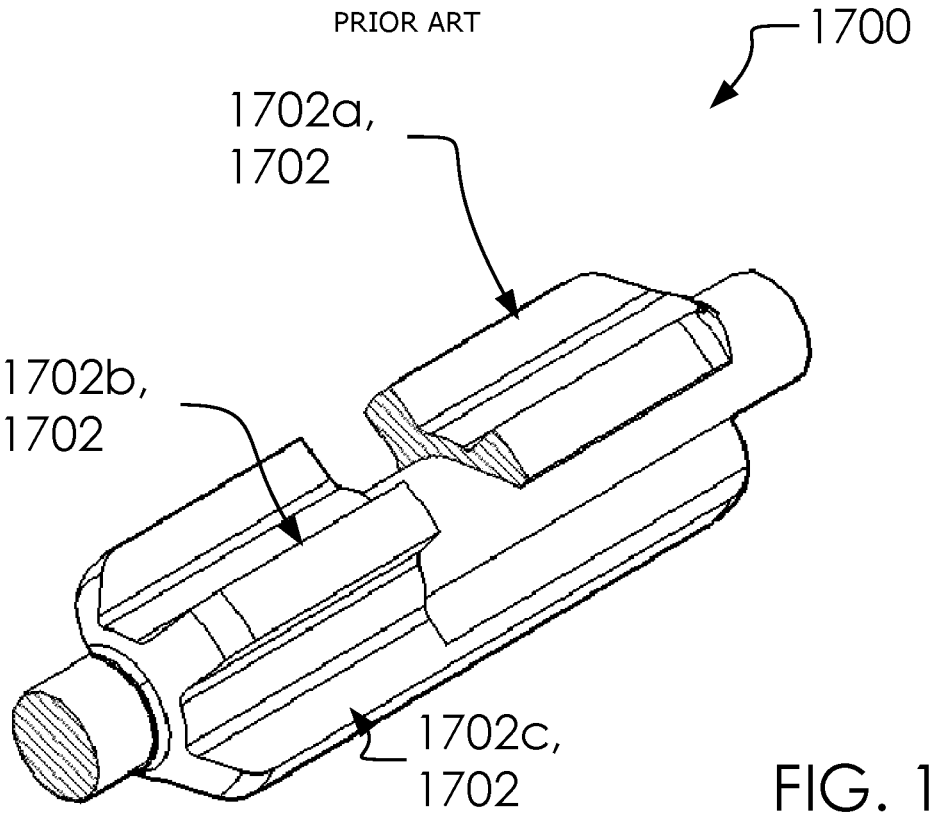
FIG. 17A PRIOR ART
FIG. 17A illustrates a perspective overview view of a prior art guide 1700.

FIG. 17A illustrates a perspective overview view of a prior art guide 1700.

Figure 17B:
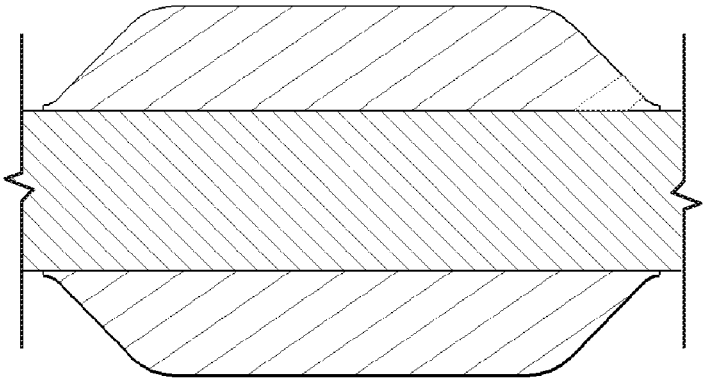
FIG. 17B illustrates an elevated first side view of a prior art guide 1700 with cross-section.

FIG. 17B illustrates an elevated first side view of a prior art guide 1700 with cross-section.

In one embodiment, said prior art guide 1700 can comprise said prior art guide 1700.

In one embodiment, said one or more surface flutes 1702 can comprise said first surface flute 1702*a*, said second surface flute 1702*b*, said third surface flute 1702*c* and said fourth surface flute 1702*d*.

A first embodiment of said prior art guide 1700 in accordance with prior art techniques. In particular, the prior art guide 1700, which is typically fabricated from a fiberglass impregnated plastic, comprises a cylindrical body having one or more surface flutes 1702, over-molded in place around a rod 204. The over-molded plastic guide uses injection pressure to assist in forming a mechanical bond with the rod surface 206.

Further, said prior art guide 1700 can comprise another embodiment in accordance with prior art techniques. In particular, the prior art guide 1700, which is typically fabricated from a fiberglass impregnated plastic, comprises a cylindrical body having one or more surface flutes 1702. The guide can be molded in one or more pieces and is then attached to a rod with a friction type fit. These guides are typically used in field service when transportation is not advantageous to the operation of the well.

Said fourth surface flute 1702*d* is not illustrated, but is essentially 180 degrees out of phase from said second surface flute 1702*b* as illustrated.

In one embodiment, said molded rod guide 100 has a structure substantially equivalent to prior art, prior art guide 1700 which is typically fabricated from a fiberglass impregnated plastic, comprises a cylindrical body having one or more surface flutes 1702. However, said molded rod guide 100 can be broken down into multiple pieces and then attached around said rod 204.

Figure 18A:
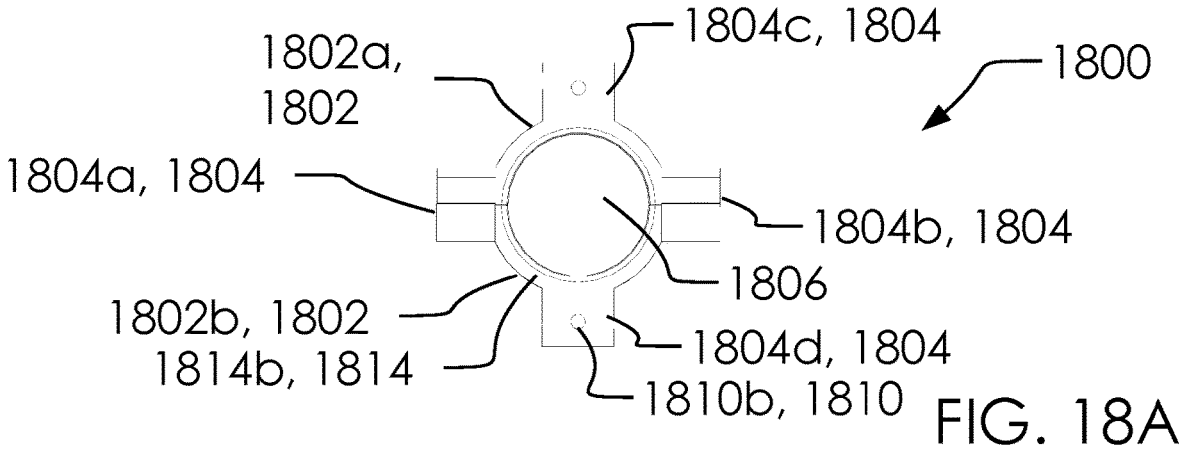
FIG. 18A illustrates an elevated front side view of a molded rod guide 1800.

FIG. 18A illustrates an elevated front side view of a molded rod guide 1800.

Figure 18B:
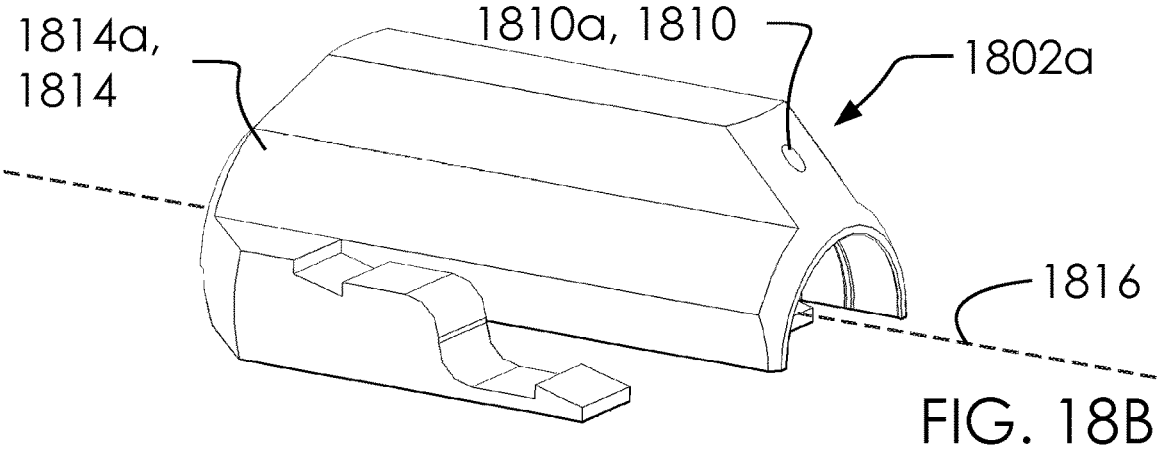
FIG. 18B illustrates a perspective overview view of a first mating portion 1802*a*.

FIG. 18B illustrates a perspective overview view of a first mating portion 1802*a*.

Figure 18C:
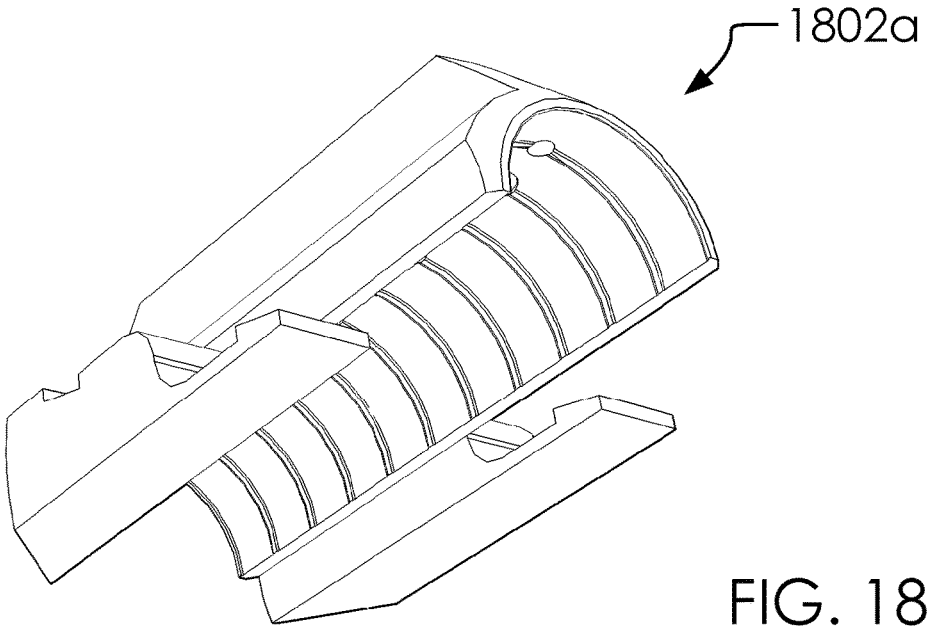
FIG. 18C illustrates a perspective bottom side view of a first mating portion 1802*a*.

FIG. 18C illustrates a perspective bottom side view of a first mating portion 1802*a*.

In one embodiment, said molded rod guide 1800 can comprise said two mating portions 1802, said one or more flutes 1804, said center channel 1806, said one or more fill ports 1810, said first end 1812, said one or more body portions 1814 and said center axis 1816.

In one embodiment, said two mating portions 1802 can comprise said first mating portion 1802*a* and said second mating portion 1802*b*.

In one embodiment, said first mating portion 1802*a* can comprise said third flute 1804*c* and said first fill port 1810*a*.

In one embodiment, said second mating portion 1802*b* can comprise said fourth flute 1804*d* and said second fill port 1810*b*.

In one embodiment, said one or more flutes 1804 can comprise said first flute 1804*a*, said second flute 1804*b*, said third flute 1804*c* and said fourth flute 1804*d*.

In one embodiment, said one or more fill ports 1810 can comprise said first fill port 1810*a* and said second fill port 1810*b*.

In one embodiment, said one or more body portions 1814 can comprise said first body portion 1814*a* and said second body portion 1814*b*.

Illustrated herein can comprise an alternative embodiment of said molded rod guide 100, namely, said molded rod guide 1800. Similarly, with said molded rod guide 100, said molded rod guide 1800 can comprise said two mating portions 1802. Said two mating portions 1802 can be selectively attached to one another.

Figure 19A:
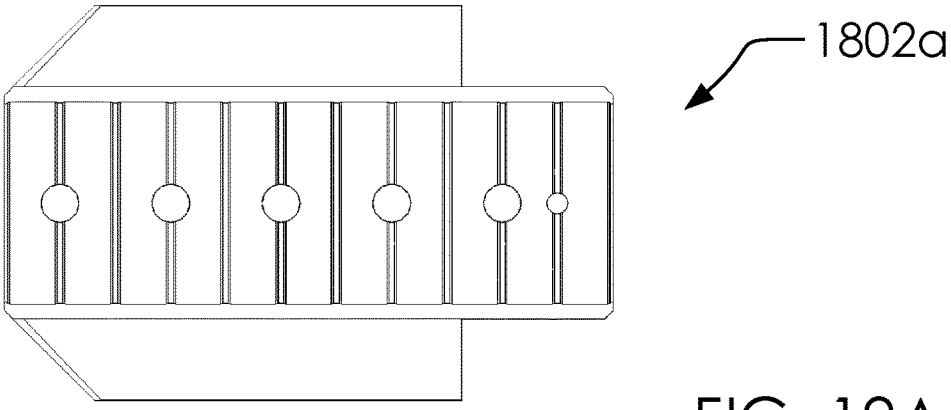
FIG. 19A illustrates an elevated bottom side view of a first mating portion 1802*a*.

FIG. 19A illustrates an elevated bottom side view of a first mating portion 1802*a*.

Figure 19B:
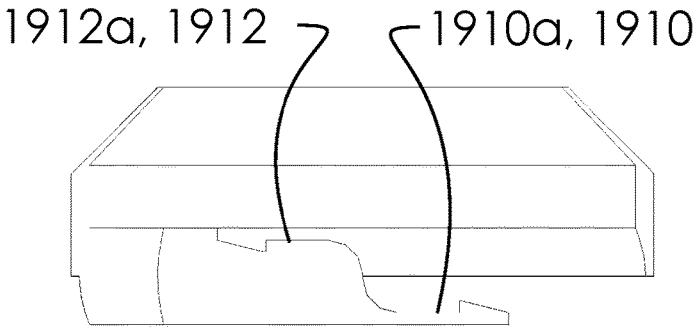
FIG. 19B illustrates an elevated first side view of a first mating portion 1802*a*.

FIG. 19B illustrates an elevated first side view of a first mating portion 1802*a*.

Figure 19C:
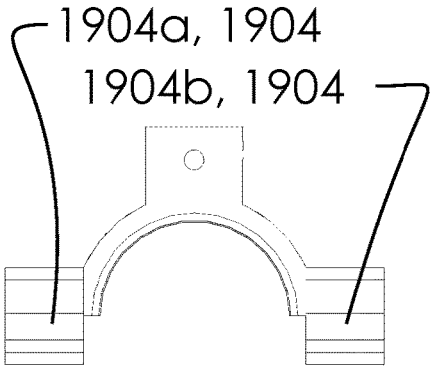
FIG. 19C illustrates an elevated front side view of a first mating portion 1802*a*.

FIG. 19C illustrates an elevated front side view of a first mating portion 1802*a*.

Figure 19D:
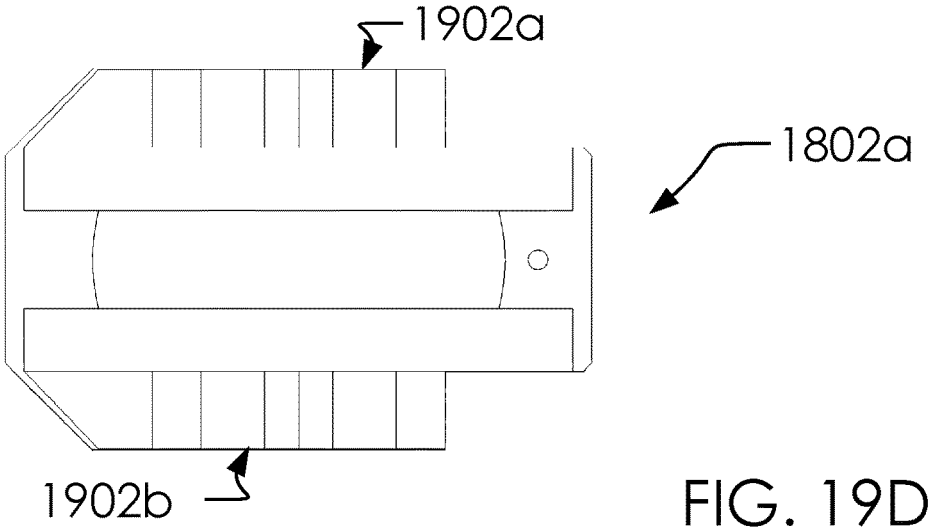
FIG. 19D illustrates an elevated top side view of a first mating portion 1802*a*.

FIG. 19D illustrates an elevated top side view of a first mating portion 1802*a*.

In one embodiment, said one or more clips 1904 can comprise said first clip 1904*a*, said second clip 1904*b*, said one or more lower faces 1910 and said one or more upper faces 1912.

In one embodiment, said first clip 1904*a* can comprise said first lower face 1910*a* and said first upper face 1912*a*.

In one embodiment, said second clip 1904*b* can comprise said second lower face 1910*b* and said second upper face 1912*b*.

In one embodiment, said one or more lower faces 1910 can comprise said first lower face 1910*a* and said second lower face 1910*b*.

In one embodiment, said one or more upper faces 1912 can comprise said first upper face 1912*a* and said second upper face 1912*b*.

In one embodiment, said two mating portions 1802 can comprise said first side 1902*a* and said second side 1902*b*.

In one embodiment, said first mating portion 1802*a* can comprise said first side 1902*a* and said second side 1902*b*.

In one embodiment, said second mating portion 1802*b* can comprise said first side 1902*a* and said second side 1902*b*.

Distinguished from said two mating portions 102, said two mating portions 1802 can comprise a different design for said clip portions 304 (that of said one or more clips 1904).

In one embodiment, said one or more clips 1904 can comprise a new design comprising said one or more lower faces 1910 and said one or more upper faces 1912. Said one or more lower faces 1910 of said first mating portion 1802*a* can fit into said one or more upper faces 1912 of said second mating portion 1802*b*. Further, said one or more clips 1904 can press into one another and hold said two mating portions 1802 together with tension.

Figure 20A:
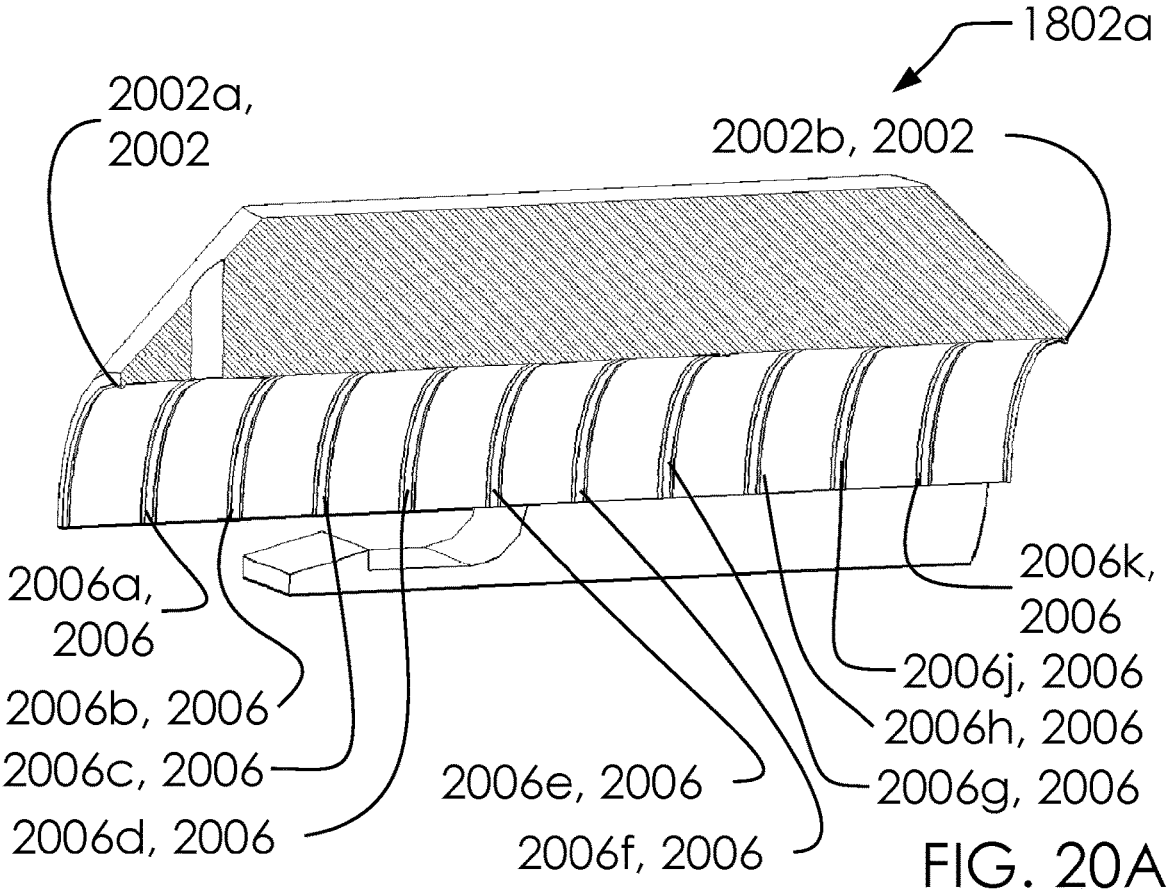
FIG. 20A illustrates a perspective second side view of a first mating portion 1802*a* in cross-section.

FIG. 20A illustrates a perspective second side view of a first mating portion 1802*a* in cross-section.

Figure 20B:
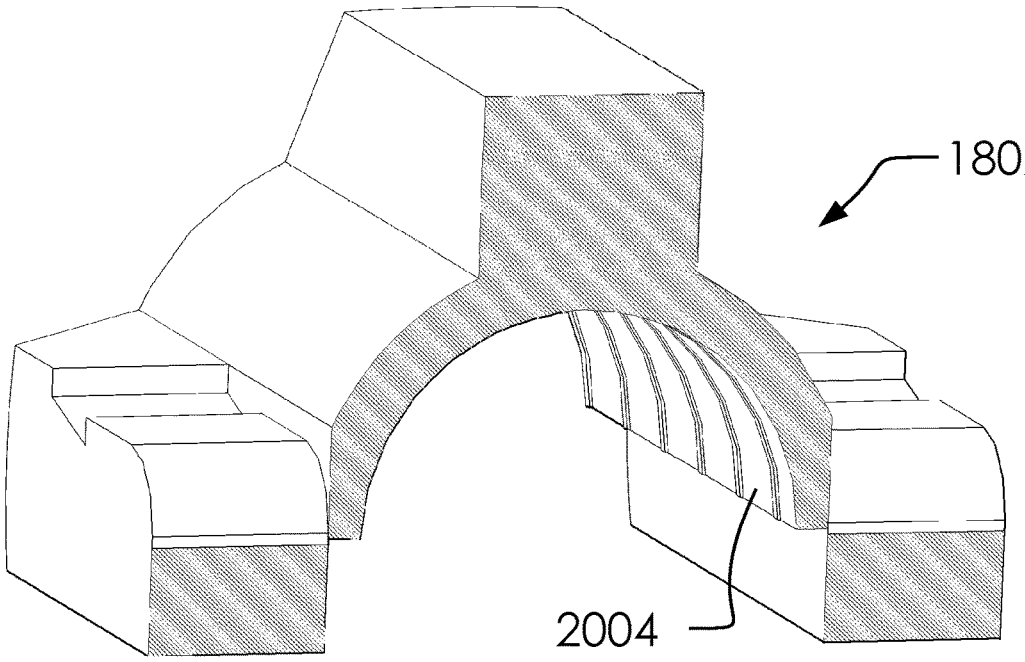
FIG. 20B illustrates a perspective back side view of a first mating portion 1802*a* in cross-section.

FIG. 20B illustrates a perspective back side view of a first mating portion 1802*a* in cross-section.

In one embodiment, said one or more beveled ends 2002 can comprise said first beveled end 2002*a* and said second beveled end 2002*b*.

In one embodiment, said one or more adhesive channels 2006 can comprise said first adhesive channel 2006*a*, said second adhesive channel 2006*b*, said third adhesive channel 2006*c*, said fourth adhesive channel 2006*d*, said fifth adhesive channel 2006*e*, said sixth adhesive channel 2006*f*, said seventh adhesive channel 2006*g*, said eight adhesive channel 2006*h*, said ninth adhesive channel 2006*j* and said tenth adhesive channel 2006*k*.

In one embodiment, said two mating portions 1802 can comprise said one or more beveled ends 2002, said interior surface 2004 and said one or more adhesive channels 2006.

In one embodiment, said first mating portion 1802*a* can comprise said one or more beveled ends 2002, said interior surface 2004 and said one or more adhesive channels 2006.

In one embodiment, said second mating portion 1802*b* can comprise said interior surface 2004.

In one embodiment, said one or more adhesive channels 2006 can channel an adhesive between said plurality of flutes 104 and said two mating portions 1802. In one embodiment, said one or more adhesive channels 2006 can line the surface of said interior surface 2004.

Figure 21:
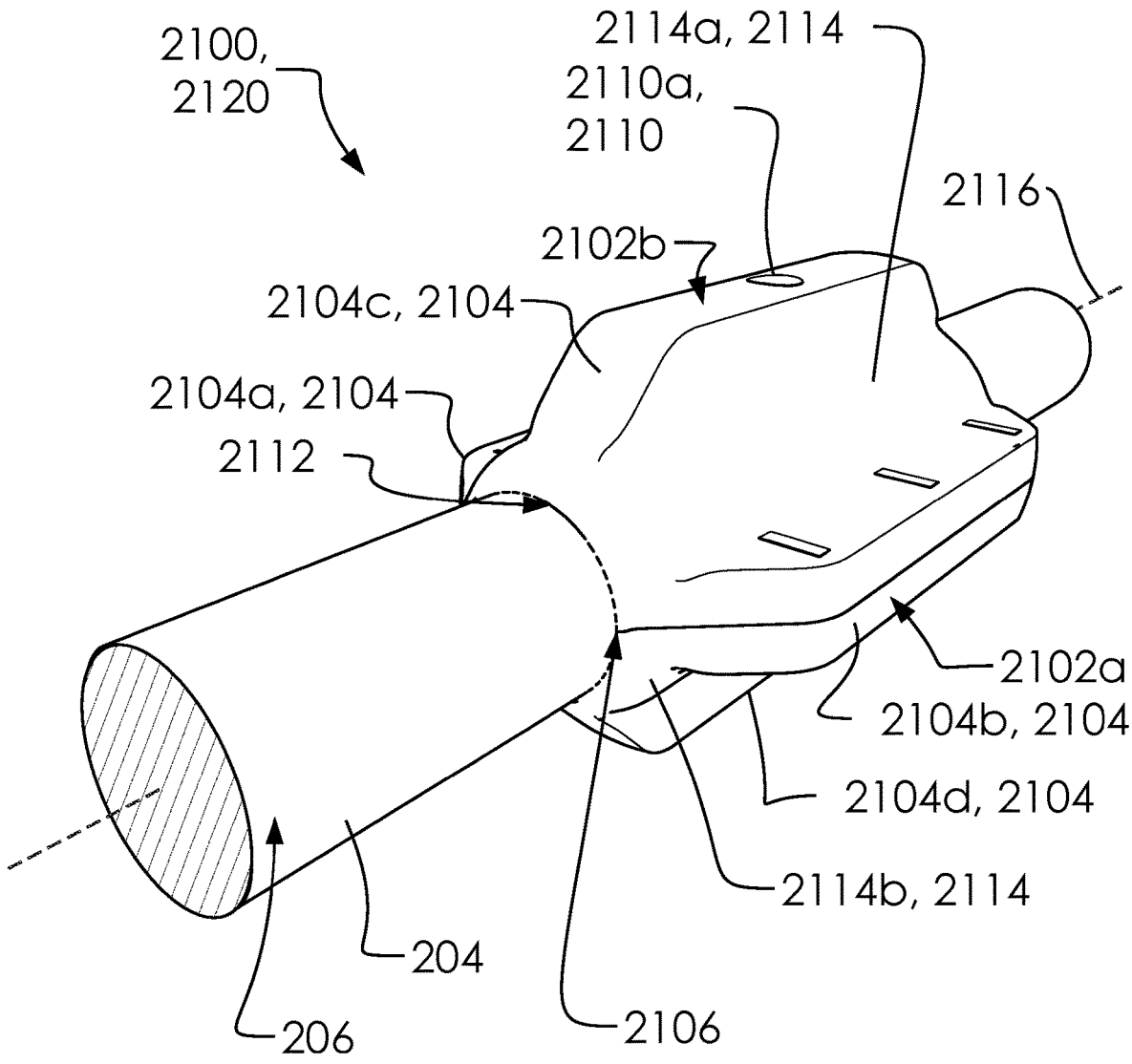
FIG. 21 illustrates a perspective overview view of a molded rod guide 2100.

FIG. 21 illustrates a perspective overview view of a molded rod guide 2100.

In one embodiment, said molded rod guide 2100 can comprise said two mating portions 2102, said one or more flutes 2104, said center channel 2106, said one or more fill ports 2110, said first end 2112, said one or more body portions 2114, said center axis 2116 and said assembled configuration 2120.

In one embodiment, said two mating portions 2102 can comprise said first mating portion 2102*a*, said second mating portion 2102*b*, said one or more flutes 2104, said one or more fill ports 2110 and said one or more body portions 2114.

In one embodiment, said first mating portion 2102*a* can comprise said third flute 2104*c*, said first fill port 2110*a* and said first body portion 2114*a*.

In one embodiment, said second mating portion 2102*b* can comprise said fourth flute 2104*d* and said second body portion 2114*b*.

In one embodiment, said one or more flutes 2104 can comprise said first flute 2104*a*, said second flute 2104*b*, said third flute 2104*c* and said fourth flute 2104*d*.

Herein, said molded rod guide 2100 can comprise yet another embodiment of said molded rod guide 100 and/or said molded rod guide 1800. In one embodiment, said molded rod guide 2100 can comprise said two mating portions 2102, as illustrated. In one embodiment, said two mating portions 2102 can attach with one another in a new manner as compared with the other embodiments.

Figure 22A:
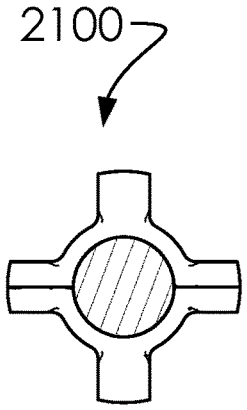
FIG. 22A illustrates an elevated front side view of a molded rod guide 2100 with said rod 204 in cross-section.

FIG. 22A illustrates an elevated front side view of a molded rod guide 2100 with said rod 204 in cross-section.

Figure 22B:
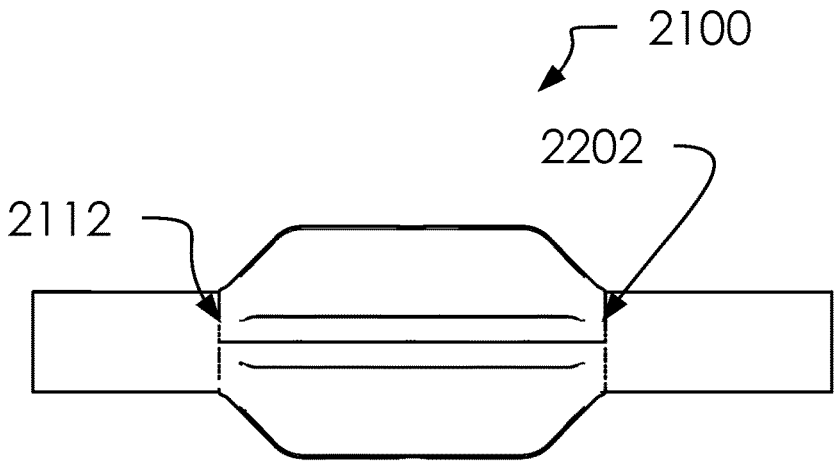
FIG. 22B illustrates an elevated front side view of a molded rod guide 2100 with a portion of said rod 204.

FIG. 22B illustrates an elevated front side view of a molded rod guide 2100 with a portion of said rod 204.

Figure 22C:
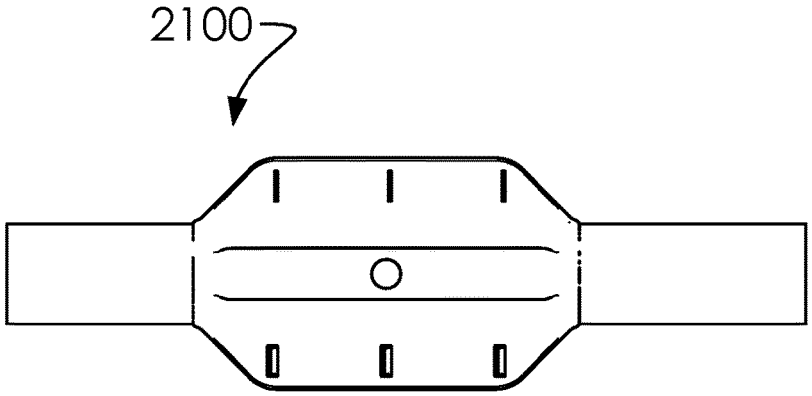
FIG. 22C illustrates an elevated top side view of a molded rod guide 2100 with a portion of said rod 204.

FIG. 22C illustrates an elevated top side view of a molded rod guide 2100 with a portion of said rod 204.

In one embodiment, said molded rod guide 2100 can comprise said second end 2202.

In one embodiment, said center channel 2106 can comprise said second end 2202.

Figure 23:
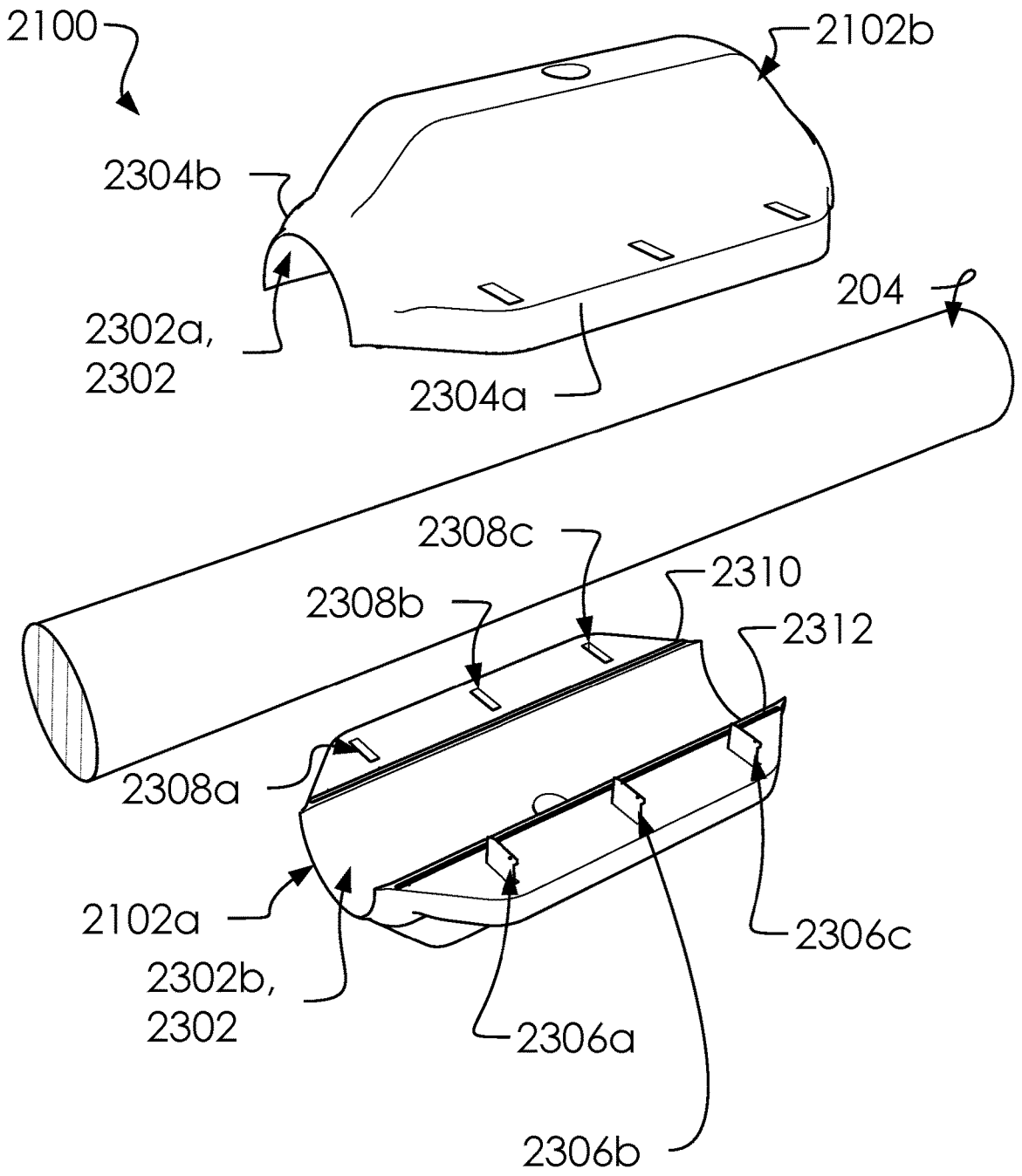
FIG. 23 illustrates an elevated top side view of a molded rod guide 2100 in an exploded view with a portion of said rod 204 in cross-section.

FIG. 23 illustrates an elevated top side view of a molded rod guide 2100 in an exploded view with a portion of said rod 204 in cross-section.

In one embodiment, said one or more interior surfaces 2302 can comprise said first interior surface 2302*a* and said second interior surface 2302*b*.

In one embodiment, said one or more tabs 2306 can comprise said first tab 2306*a*, said second tab 2306*b* and said third tab 2306*c*.

In one embodiment, said one or more slots 2308 can comprise said first slot 2308*a*, said second slot 2308*b* and said third slot 2308*c*.

In one embodiment, said molded rod guide 2100 can comprise said one or more interior surfaces 2302, said first side 2304*a* and said second side 2304*b*.

In one embodiment, said two mating portions 2102 can comprise said one or more interior surfaces 2302, said first interior surface 2302*a*, said second interior surface 2302*b*, said first side 2304*a*, said second side 2304*b*, said second side 2304*b*, said one or more tabs 2306, said third tab 2306*c*, said one or more slots 2308, said long tab 2310, said long slot 2312 and said long slot 2312.

In one embodiment, said first mating portion 2102*a* can comprise said first interior surface 2302*a*, said first side 2304*a*, said second side 2304*b*, said one or more tabs 2306, said first tab 2306*a*, said second tab 2306*b*, said third tab 2306*c*, said one or more slots 2308, said first slot 2308*a*, said second slot 2308*b*, said third slot 2308*c*, said long tab 2310 and said long slot 2312.

In one embodiment, said second mating portion 2102*b* can comprise said second interior surface 2302*b*, said first side 2304*a*, said second side 2304*b*, said one or more tabs 2306, said third tab 2306*c*, said one or more slots 2308, said long tab 2310 and said long slot 2312.

In one embodiment, 3 rod surface 206 of one among said two mating portions 2102 can attach to said one or more slots 2308 of the other among said two mating portions 2102.

Figure 24A:
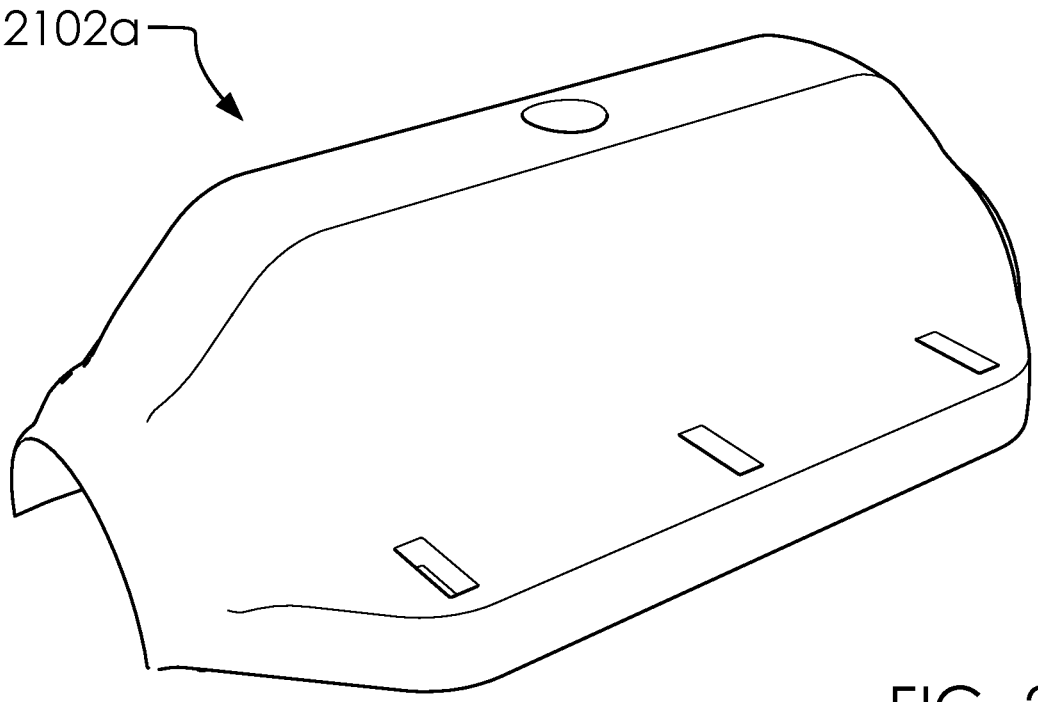
FIG. 24A illustrates a perspective overview view of a first mating portion 2102*a*.

FIG. 24A illustrates a perspective overview view of a first mating portion 2102*a*.

Figure 24B:
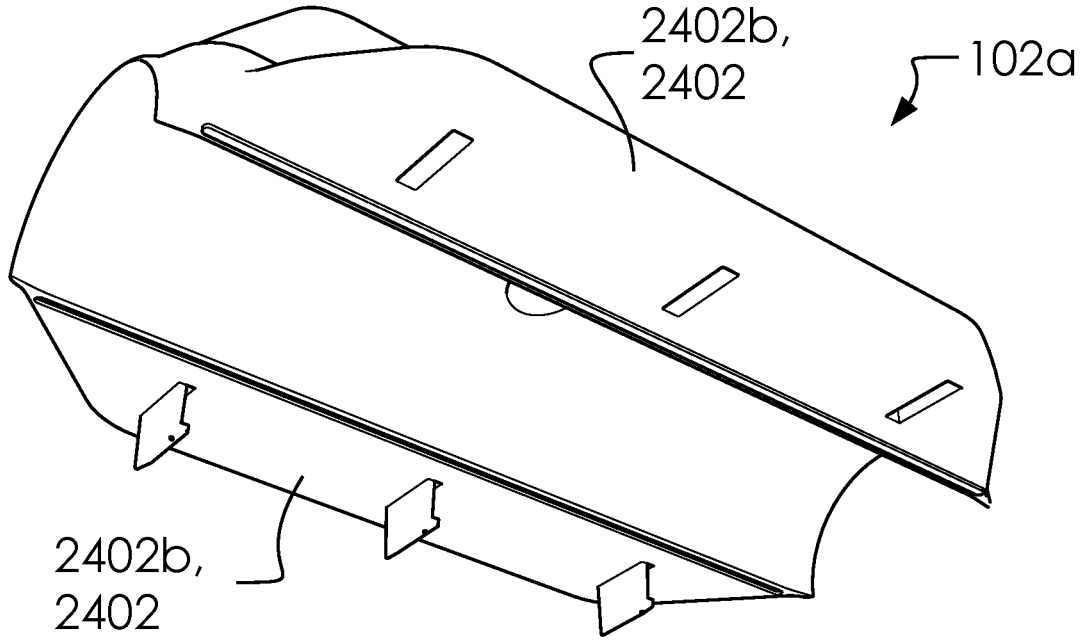
FIG. 24B illustrates a perspective bottom side view of a first mating portion 2102*a*.

FIG. 24B illustrates a perspective bottom side view of a first mating portion 2102*a*.

In one embodiment, said two half flutes 2402 can comprise said first half flute 2402*a* and said second half flute 2402*b*.

In one embodiment, said second mating portion 2102*b* can comprise said two half flutes 2402.

In one embodiment, said one or more flutes 2104 can comprise said two half flutes 2402, said first half flute 2402*a* and said second half flute 2402*b*.

In one embodiment, said one or more tabs 2306 can comprise said second half flute 2402*b*.

Figure 25A:
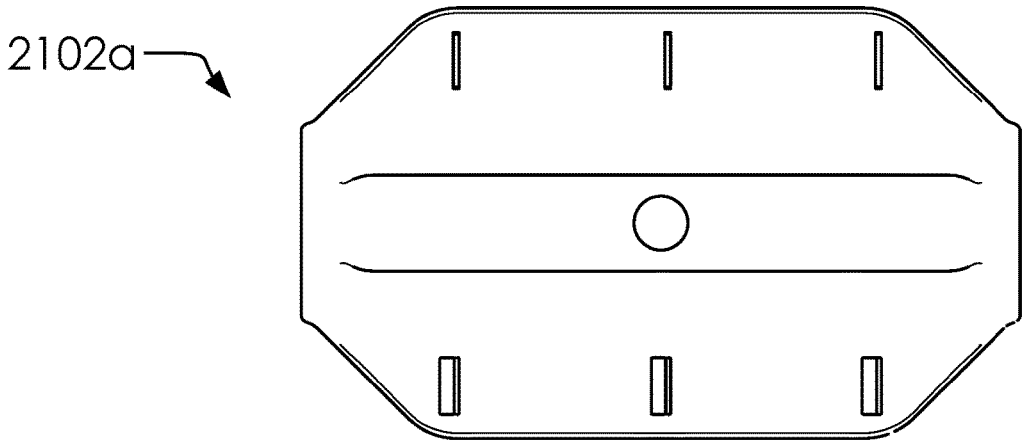
FIG. 25A illustrates an elevated top side view of a first mating portion 2102*a*.

FIG. 25A illustrates an elevated top side view of a first mating portion 2102*a*.

Figure 25B:
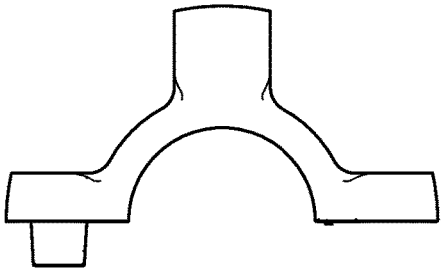
FIG. 25B illustrates an elevated front side view of a first mating portion 2102*a*.

FIG. 25B illustrates an elevated front side view of a first mating portion 2102*a*.

Figure 25C:
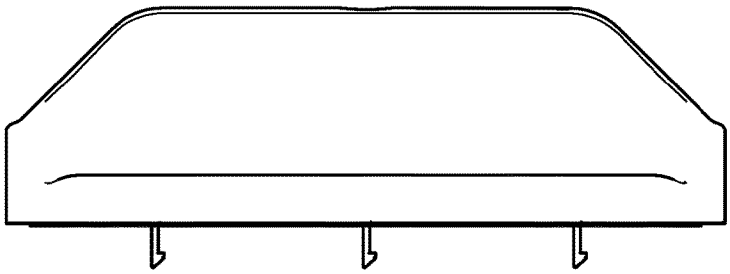
FIG. 25C illustrates an elevated first side view of a first mating portion 2102*a*.

FIG. 25C illustrates an elevated first side view of a first mating portion 2102*a*.

Figure 25D:
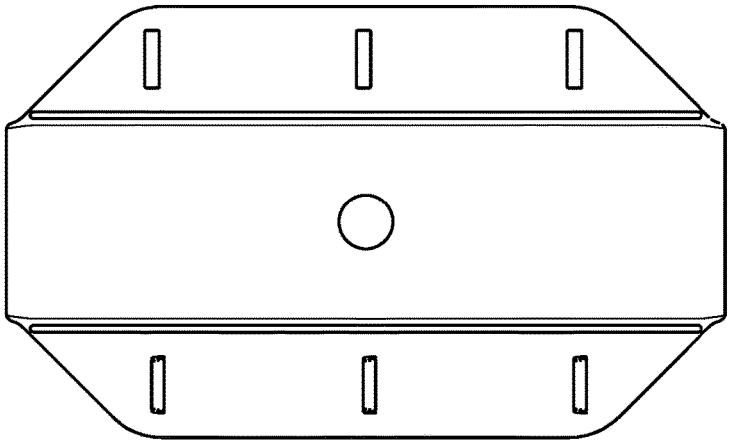
FIG. 25D illustrates an elevated bottom side view of a first mating portion 2102*a*.

FIG. 25D illustrates an elevated bottom side view of a first mating portion 2102*a*.

Figure 26A:
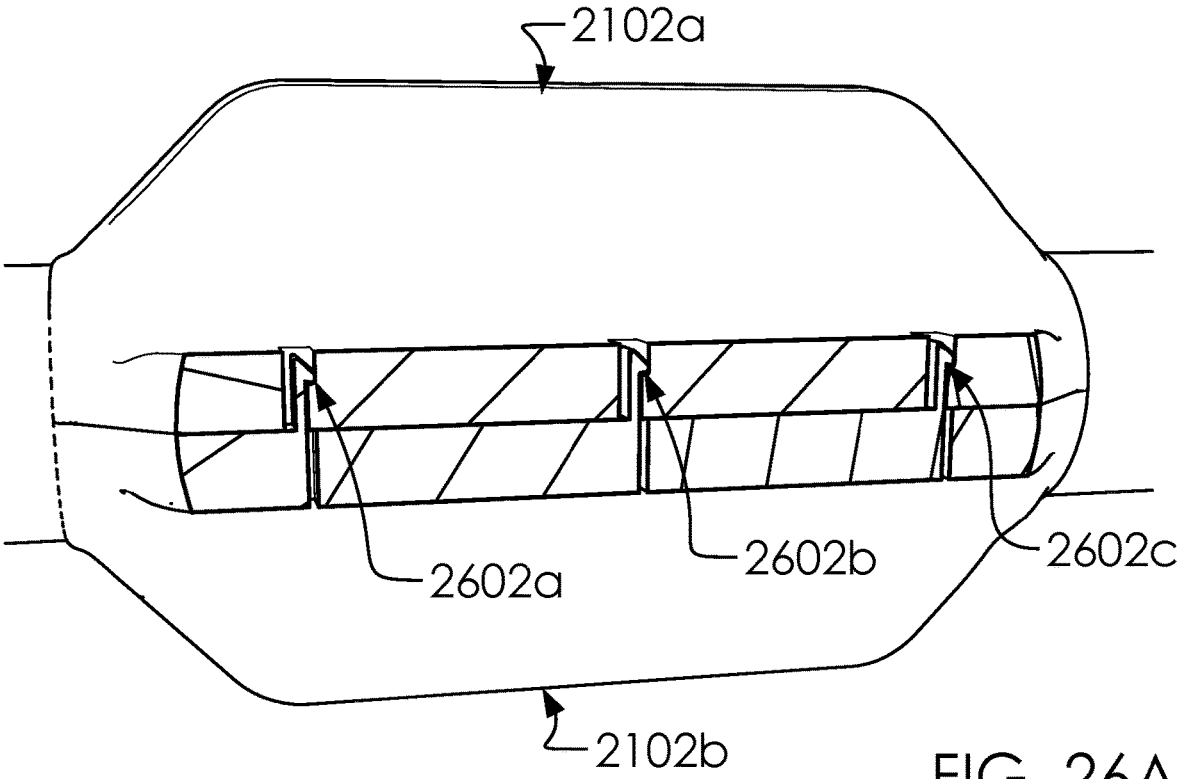
FIG. 26A illustrates a perspective overview view of a two mating portions 2102 in cross-section to expose a portion of said one or more clips 2602.

FIG. 26A illustrates a perspective overview view of a two mating portions 2102 in cross-section to expose a portion of said one or more clips 2602.

Figure 26B:
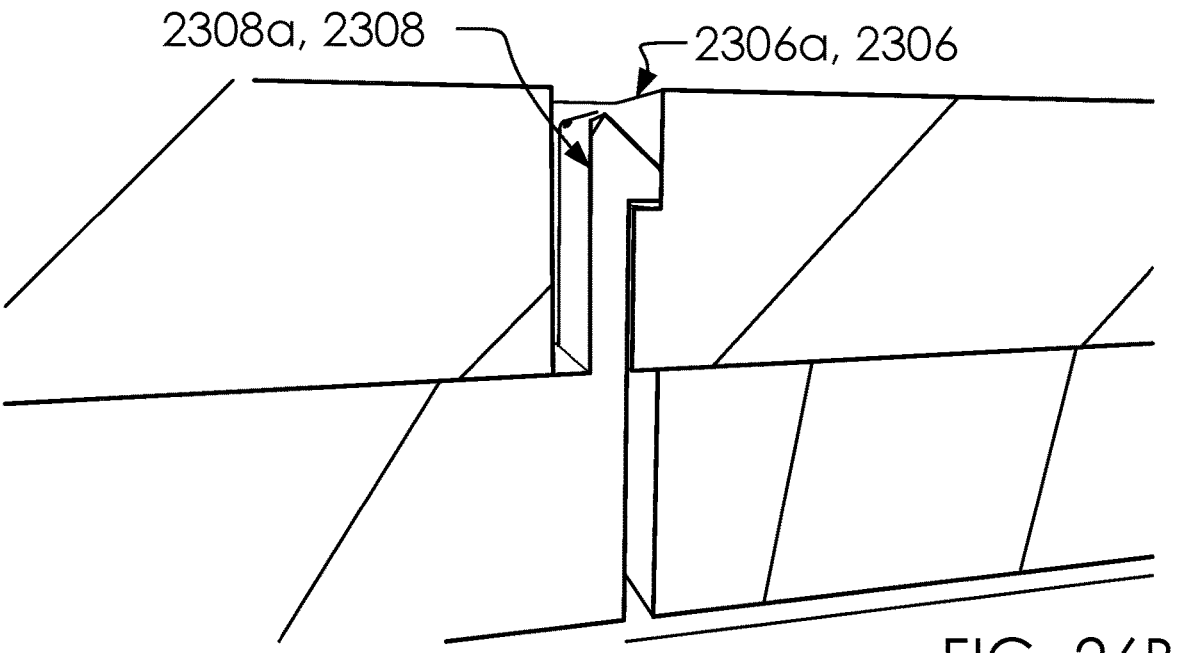
FIG. 26B illustrates a perspective overview view of a two mating portions 2102.

FIG. 26B illustrates a perspective overview view of a two mating portions 2102.

In one embodiment, said one or more clips 2602 can comprise said first clip 2602*a*, said second clip 2602*b* and said third clip 2602*c*.

In one embodiment, said two mating portions 2102 can comprise said one or more clips 2602.

In one embodiment, said first tab 2306*a* can comprise said first clip 2602*a*.

In one embodiment, said second tab 2306*b* can comprise said second clip 2602*b*.

In one embodiment, said third tab 2306*c* can comprise said third clip 2602*c*.

In one embodiment, said one or more clips 2602 can snap into said one or more slots 2308, so as to secure said two mating portions 2102 to one another, as illustrated. Additionally, said one or more clips 2602 can be released within said one or more slots 2308 by unclipping said one or more tabs 2306 from said one or more slots 2308.

As illustrated, said first mating portion 2102*a* can snap into said second mating portion 2102*b* with said one or more slots 2308 selectively held to said one or more tabs 2306. Further, said long tab 2310 can slide into said long slot 2312 to further secure said two mating portions 2102 to one another.

Figure 27:
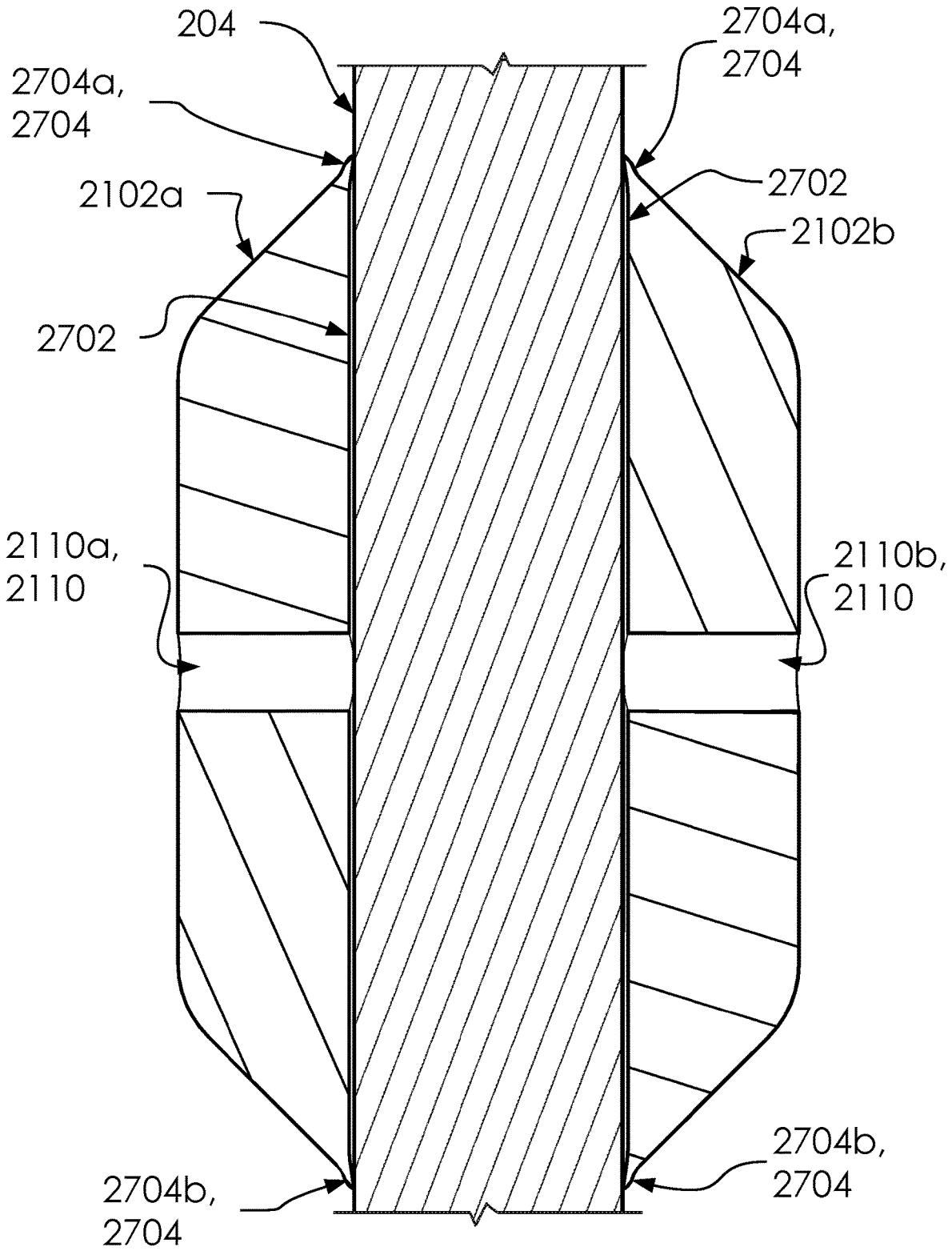
FIG. 27 illustrates an elevated first side view of a molded rod guide 2100 with said rod 204, both in cross-section to show said gap 2702.

FIG. 27 illustrates an elevated first side view of a molded rod guide 2100 with said rod 204, both in cross-section to show said gap 2702.

In one embodiment, said one or more beveled edges 2704 can comprise said first beveled edge 2704*a* and said second beveled edge 2704*b*.

In one embodiment, said molded rod guide 2100 can comprise said gap 2702 and said one or more beveled edges 2704.

In one embodiment, said two mating portions 2102 can comprise said one or more beveled edges 2704.

Figure 28:
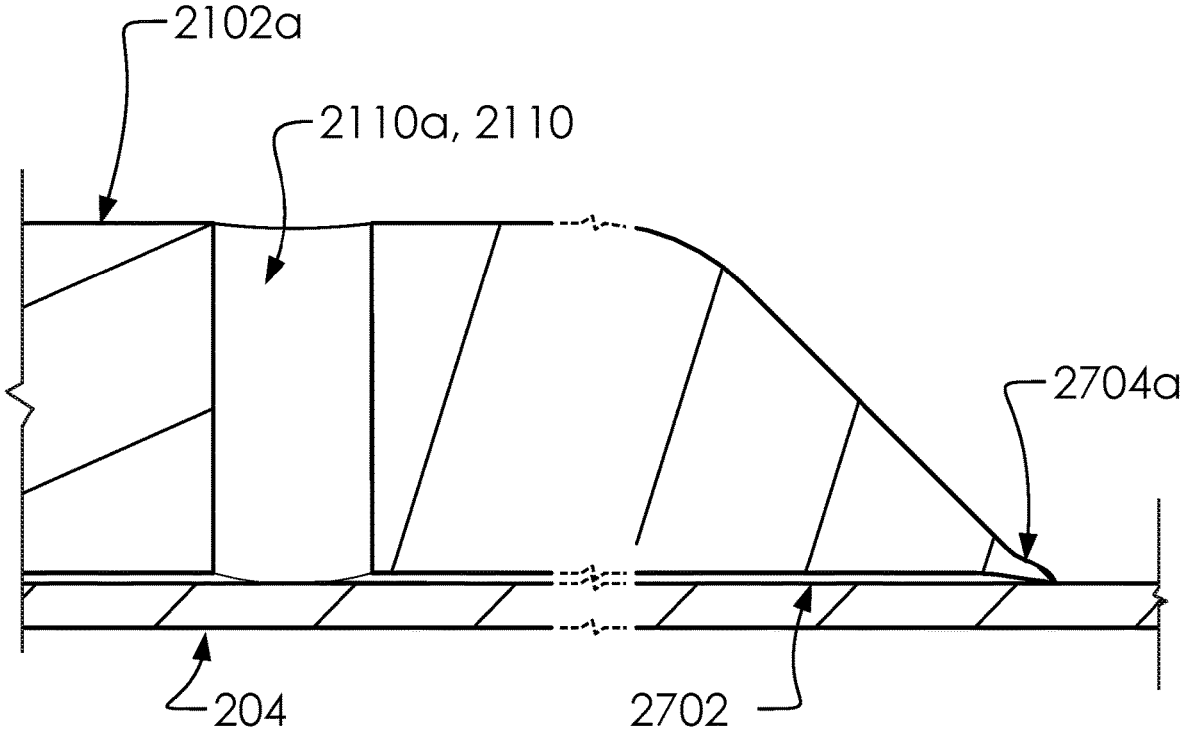
FIG. 28 illustrates an elevated first side view of a molded rod guide 2100 in cross-section in detail to show said gap 2702 in detail.

FIG. 28 illustrates an elevated first side view of a molded rod guide 2100 in cross-section in detail to show said gap 2702 in detail.

Figure 29:
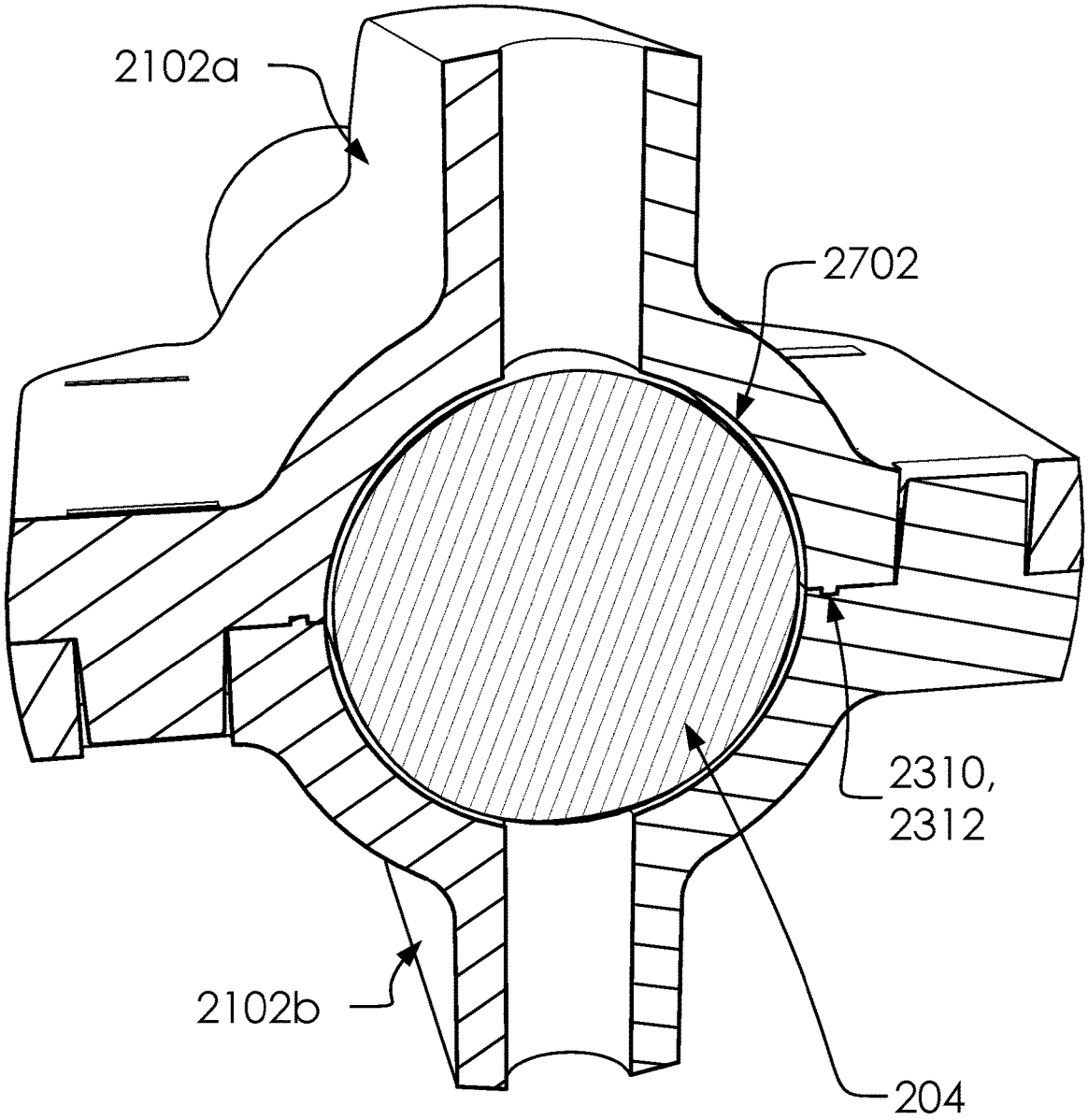
FIG. 29 illustrates a perspective front side view of a molded rod guide 2100 with said rod 204, both in cross-section.

FIG. 29 illustrates a perspective front side view of a molded rod guide 2100 with said rod 204, both in cross-section.

Figure 30:
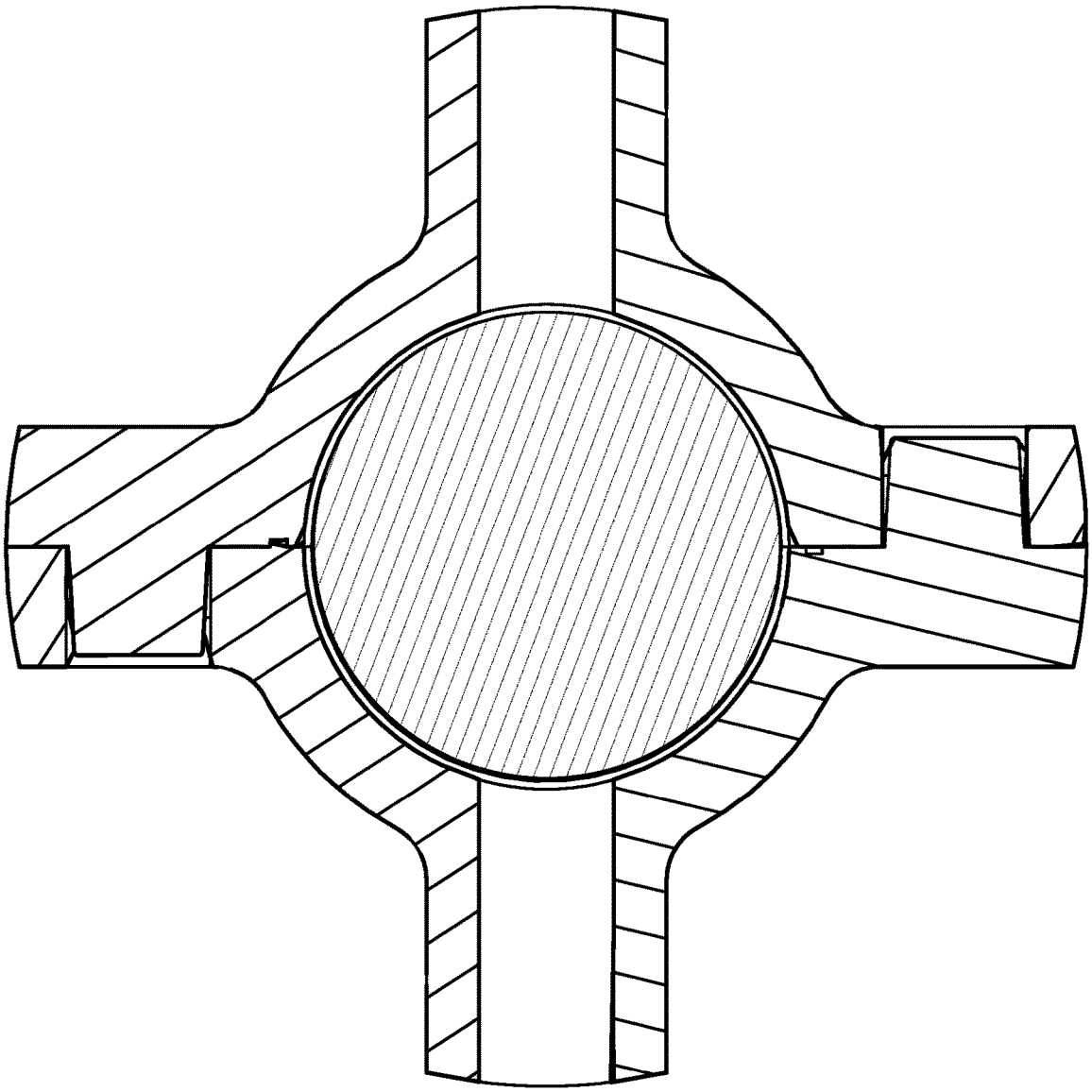
FIG. 30 illustrates an elevated front side view of a molded rod guide 2100 in cross-section.

FIG. 30 illustrates an elevated front side view of a molded rod guide 2100 in cross-section The following sentences are included for completeness of this disclosure with reference to the claims.

A molded rod guide 100 for guiding and protecting a sucker rod in a fluid mineral extraction setting. Said molded rod guide 100 comprising a two mating portions 102 and a center channel 106. Said two mating portions 102 comprise a first mating portion 102*a* and a second mating portion 102*b*. Said two mating portions 102 are configured to selectively mate with one another and form said center channel 106. Said two mating portions 102 comprise an assembled configuration 120 and a separated configuration 1000. With said two mating portions 102 in said assembled configuration 120, said molded rod guide 100 comprises a plurality of flutes 104, a body portion 114, a width 122 and a height 124. Said body portion 114 wraps around said center channel 106. Said center channel 106 comprises a center axis 116. Said molded rod guide 100 is configured to selectively surround a portion of a rod 204 by wrapping said center channel 106 around a portion of said rod 204. Said plurality of flutes 104 extend in a radially outward direction 126 from said center axis 116 and said body portion 114.

Each among said two mating portions 102 comprise a side portions 302. Said side portions 302 comprise a first side 302*a* and a second side 302*b*. Each of said side portions 302 comprise a clip portions 304.

Each of said two mating portions 102 comprise an exterior surface 902 and an interior surface 904. Said exterior surface 902 comprise a portion of said center channel 106. Said exterior surface 902 of said first mating portion 102*a* and said second mating portion 102*b* are configured to mate and create a cylindrical shape with a first end 112 and a second end 202 being open to accommodate said rod 204. For each among said two mating portions 102 said exterior surface 902 comprise a half cylindrical shape being cut along lines being parallel with said center axis 116. Said interior surface 904 comprises portions of said body portion 114 being opposite said exterior surface 902.

Each among said two mating portions 102 comprise said side portions 302, and a top flute 906. Said plurality of flutes 104 comprise a first flute 104*a*, a second flute 104*b*, a third flute 104*c* and a fourth flute 104*d*. With said two mating portions 102 in said assembled configuration 120. Said top flute 906 of said first mating portion 102*a* comprises said first flute 104*a*. Said first side 302*a* of said first mating portion 102*a* attached to said second side 302*b* of said second mating portion 102*b* comprises said second flute 104*b*. Said top flute 906 of said second mating portion 102*b* comprises said third flute 104*c*, and. Said second side 302*b* of said first mating portion 102*a* attached to said first side 302*a* of said second mating portion 102*b* comprise said fourth flute 104*d*.

Each of said side portions 302 comprise a first end 502, a second end 504, a one or more lower faces 310, a one or more upper faces 312 and a gap 510. Said second end 504 is attached to said body portion 114. Said first end 502 comprises said gap 510 between said body portion 114 and said side portions 302. Said side portions 302 of said first mating portion 102*a* selectively snap into said side portions 302 of said second mating portion 102*b*, wherein said first side 302*a* of said first mating portion 102*a* mates with said second side 302*b* of said second mating portion 102*b*, and said second side 302*b* of said first mating portion 102*a* mates with said first side 302*a* of said second mating portion 102*b*.

A lower dimples 306 and an upper dimples 308 comprise small round or elongated portions of said one or more lower faces 310 and said one or more upper faces 312. Said one or more lower faces 310 are convex and said one or more upper faces 312 is concave. Said one or more lower faces 310 and said one or more upper faces 312 are designed to mate with one another when said first mating portion 102*a* and said second mating portion 102*b* are inverted relative to one another and attached, as in said assembled configuration 120. Said one or more lower faces 310 is convex and said lower dimples 306 can be concave. Said one or more upper faces 312 is concave said upper dimples 308 can be convex. Said lower dimples 306 and said upper dimples 308 are designed to snap into one another with said two mating portions 102 in said assembled configuration 120.

Said molded rod guide 100 further comprises a one or more fill ports 110, an interior surface 804, a one or more adhesive channels 806, a cavity 1302 and an adhesive 1400. Said one or more adhesive channels 806 line said interior surface 804 of said center channel 106. Said one or more adhesive channels 806 comprise spaces between said interior surface 804 on said center channel 106. Said molded rod guide 100 is configured to selectively attach to said rod 204 by attaching said two mating portions 102 around a portion of said rod 204, attaching said first mating portion 102*a* to said second mating portion 102*b*, injecting said adhesive 1400 into said one or more fill ports 110, and filling said cavity 1302 with portions of said adhesive 1400. Said one or more adhesive channels 806 force portions of said adhesive 1400 into said interior surface 804.

Said one or more fill ports 110 comprise holes in a portion of said plurality of flutes 104. Said molded rod guide 100 comprise an exterior surface 902 and an interior surface 904. Said exterior surface 902 comprises a space within said center channel 106. Said one or more fill ports 110 is configured to receive a portion of said adhesive 1400 and channel a portion of said adhesive 1400 between said one or more adhesive channels 806.

Said molded rod guide 100 further comprises a one or more beveled ends 802 at a first end 112 and a second end 202 of said center channel 106. Said second end 202 are configured to press into said rod 204 with said molded rod guide 100 in said assembled configuration 120. Said interior surface 804 comprises a space between said center channel 106, said one or more adhesive channels 806, and said one or more beveled ends 802.

Said one or more adhesive channels 806 comprise at least a first adhesive channel 806*a* and a second adhesive channel 806*b*. Said one or more adhesive channels 806 comprise a one or more gaps 808 configured to allow portions of said adhesive 1400 to pass between said one or more adhesive channels 806. Said one or more beveled ends 802 and said one or more adhesive channels 806 are configured to fit snuggly around said rod 204. Said interior surface 804 are configured to provide a cavity for holding said adhesive 1400 between said one or more adhesive channels 806, and said one or more beveled ends 802. Said adhesive 1400 is configured to bond at least with a portion of said rod 204. Said adhesive 1400 is configured to dry and become an adhesive damn 1404 to prevent movement along said center axis 116 by blocking a portion of said one or more adhesive channels 806 and/or said one or more beveled ends 802.

Said one or more adhesive channels 806 comprise at least a first adhesive channel 806*a* and a second adhesive channel 806*b*. Said one or more adhesive channels 806 comprise a one or more gaps 808 configured to allow portions of said adhesive 1400 to pass between said one or more adhesive channels 806. Said one or more beveled ends 802 and said one or more adhesive channels 806 are configured to fit snuggly around said rod 204. Said interior surface 804 are configured to provide a cavity for holding said adhesive 1400 between said one or more adhesive channels 806, and said one or more beveled ends 802. Said adhesive 1400 is configured to bond said molded rod guide 100 to a portion of said rod 204. Said one or more adhesive channels 806 and said one or more beveled ends 802 with said adhesive 1400 in said interior surface 804 provide a mechanical interference 1406 to movement along said center axis 116. A molded rod guide 100 for guiding and protecting a sucker rod in a fluid mineral extraction setting.

Said molded rod guide 100 further comprises a one or more fill ports 110, an interior surface 804, a one or more adhesive channels 806, a cavity 1302 and an adhesive 1400. Said one or more adhesive channels 806 line said interior surface 804 of a center channel 106. Said one or more adhesive channels 806 comprise spaces between said interior surface 804 on said center channel 106. Said molded rod guide 100 is configured to selectively attach to a rod 204 by attaching a two mating portions 102 around a portion of said rod 204, attaching a first mating portion 102*a* to a second mating portion 102*b*, injecting said adhesive 1400 into said one or more fill ports 110, and filling said cavity 1302 with portions of said adhesive 1400. Said one or more adhesive channels 806 force portions of said adhesive 1400 into said interior surface 804. Said one or more fill ports 110 comprise holes in a portion of a plurality of flutes 104. Said molded rod guide 100 comprise an exterior surface 902 and an interior surface 904. Said exterior surface 902 comprises a space within said center channel 106. Said one or more fill ports 110 is configured to receive a portion of said adhesive 1400 and channel a portion of said adhesive 1400 between said one or more adhesive channels 806. Said molded rod guide 100 further comprises a one or more beveled ends 802 at a first end 112 and a second end 202 of said center channel 106. Said second end 202 are configured to press into said rod 204 with said molded rod guide 100 in an assembled configuration 120. Said interior surface 804 comprises a space between said center channel 106, said one or more adhesive channels 806, and said one or more beveled ends 802. Said one or more adhesive channels 806 comprise at least a first adhesive channel 806*a* and a second adhesive channel 806*b*. Said one or more adhesive channels 806 comprise a one or more gaps 808 configured to allow portions of said adhesive 1400 to pass between said one or more adhesive channels 806. Said one or more beveled ends 802 and said one or more adhesive channels 806 are configured to fit snuggly around said rod 204. Said interior surface 804 are configured to provide a cavity for holding said adhesive 1400 between said one or more adhesive channels 806, and said one or more beveled ends 802. Said adhesive 1400 is configured to bond said molded rod guide 100 to a portion of said rod 204. Said one or more adhesive channels 806 and said one or more beveled ends 802 with said adhesive 1400 in said interior surface 804 provide mechanical resistance to movement along a center axis 116. A method of use 1600 of a molded rod guide 100 for guiding and protecting a sucker rod in a fluid mineral extraction setting. Comprising Selectively attaching a two mating portions 102 to one another around a portion of a rod 204 and. Filling a space between said two mating portions 102 and said rod 204 with an adhesive 1400. Wherein. Said molded rod guide 100 further comprises a one or more fill ports 110, an interior surface 804, a one or more adhesive channels 806, a cavity 1302 and said adhesive 1400. Said one or more adhesive channels 806 line said interior surface 804 of a center channel 106. Said one or more adhesive channels 806 comprise spaces between said interior surface 804 on said center channel 106. Said molded rod guide 100 is configured to selectively attach to said rod 204 by attaching said two mating portions 102 around a portion of said rod 204, attaching a first mating portion 102*a* to a second mating portion 102*b*, injecting said adhesive 1400 into said one or more fill ports 110, and filling said cavity 1302 with portions of said adhesive 1400. Said one or more adhesive channels 806 force portions of said adhesive 1400 into said interior surface 804. Said one or more fill ports 110 comprise holes in a portion of a plurality of flutes 104. Said molded rod guide 100 comprise an exterior surface 902 and an interior surface 904. Said exterior surface 902 comprises a space within said center channel 106. Said one or more fill ports 110 is configured to receive a portion of said adhesive 1400 and channel a portion of said adhesive 1400 between said one or more adhesive channels 806.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A molded rod guide for guiding and protecting a sucker rod in a fluid mineral extraction setting, wherein:

said molded rod guide comprising a two mating portions and a center channel;

said two mating portions comprise a first mating portion and a second mating portion;

said two mating portions are configured to selectively mate with one another and form said center channel;

said two mating portions comprise an assembled configuration and a separated configuration;

with said two mating portions in said assembled configuration, said molded rod guide comprises a plurality of flutes, a body portion, a width and a height;

said body portion wraps around said center channel;

said center channel comprises a center axis;

said molded rod guide is configured to selectively surround a portion of a rod by wrapping said center channel around a portion of said rod;

said plurality of flutes extend in a radially outward direction from said center axis and said body portion;

each among said two mating portions comprise a side portions;

said side portions comprise a first side and a second side; and each of said side portions comprise a clip portions.

2. The molded rod guide from claim 1, wherein:

each of said two mating portions comprise an exterior surface and an interior surface;

said exterior surface comprise a portion of said center channel;

said exterior surface of said first mating portion and said second mating portion are configured to mate and create a cylindrical shape with a first end and a second end being open to accommodate said rod;

for each among said two mating portions said exterior surface comprise a half cylindrical shape being cut along lines being parallel with said center axis; and said interior surface comprises portions of said body portion being opposite said exterior surface.

3. The molded rod guide from claim 1, wherein:

each among said two mating portions comprise said side portions, and a top flute;

said plurality of flutes comprise a first flute, a second flute, a third flute and a fourth flute;

with said two mating portions in said assembled configuration:

said top flute of said first mating portion comprises said third flute, said first side of said first mating portion attached to said second side of said second mating portion comprises said first flute, said top flute of said second mating portion comprises said fourth flute, and said second side of said first mating portion attached to said first side of said second mating portion comprise said second flute.

4. The molded rod guide from claim 1, wherein:

each of said side portions comprise a first end, a second end, a one or more lower faces, a one or more upper faces and a gap;

said second end is attached to said body portion;

said first end comprises said gap between said body portion and said side portions; and said side portions of said first mating portion selectively snap into said side portions of said second mating portion, wherein said first side of said first mating portion mates with said second side of said second mating portion, and said second side of said first mating portion mates with said first side of said second mating portion.

5. The molded rod guide from claim 4, wherein:

a lower dimples and an upper dimples comprise small round or elongated portions of said one or more lower faces and said one or more upper faces;

said one or more lower faces are convex and said one or more upper faces is concave;

said one or more lower faces and said one or more upper faces are designed to mate with one another when said first mating portion and said second mating portion are inverted relative to one another and attached, as in said assembled configuration;

said one or more lower faces is convex and said lower dimples can be concave;

said one or more upper faces is concave said upper dimples can be convex; and said lower dimples and said upper dimples are designed to snap into one another with said two mating portions in said assembled configuration.

6. The molded rod guide from claim 1, wherein:

said molded rod guide further comprises a one or more fill ports, an interior surface, a one or more adhesive channels, a cavity and an adhesive;

said one or more adhesive channels line said interior surface of said center channel;

said one or more adhesive channels comprise spaces between said interior surface on said center channel;

said molded rod guide is configured to selectively attach to said rod by attaching said two mating portions around a portion of said rod, attaching said first mating portion to said second mating portion, injecting said adhesive into said one or more fill ports, and filling said cavity with portions of said adhesive; and said one or more adhesive channels force portions of said adhesive into said interior surface.

7. The molded rod guide from claim 6, wherein:

said one or more fill ports comprise holes in a portion of said plurality of flutes;

said molded rod guide comprise an exterior surface and an interior surface;

said exterior surface comprises a space within said center channel; and said one or more fill ports is configured to receive a portion of said adhesive and channel a portion of said adhesive between said one or more adhesive channels.

8. The molded rod guide from claim 6, wherein:

said molded rod guide further comprises a one or more beveled ends at a first end and a second end of said center channel;

said second end are configured to press into said rod with said molded rod guide in said assembled configuration; and said interior surface comprises a space between said center channel, said one or more adhesive channels, and said one or more beveled ends.

9. The molded rod guide from claim 8, wherein:

said one or more adhesive channels comprise at least a first adhesive channel and a second adhesive channel;

said one or more adhesive channels comprise a one or more gaps configured to allow portions of said adhesive to pass between said one or more adhesive channels;

said one or more beveled ends and said one or more adhesive channels are configured to fit snuggly around said rod;

said interior surface are configured to provide a cavity for holding said adhesive between said one or more adhesive channels, and said one or more beveled ends;

said adhesive is configured to bond at least with a portion of said rod; and said adhesive is configured to dry and become an adhesive damn to prevent movement along said center axis by blocking a portion of said one or more adhesive channels and/or said one or more beveled ends.

10. The molded rod guide from claim 8, wherein:

said one or more adhesive channels comprise at least a first adhesive channel and a second adhesive channel;

said one or more adhesive channels comprise a one or more gaps configured to allow portions of said adhesive to pass between said one or more adhesive channels;

said one or more beveled ends and said one or more adhesive channels are configured to fit snuggly around said rod;

said interior surface are configured to provide a cavity for holding said adhesive between said one or more adhesive channels, and said one or more beveled ends;

said adhesive is configured to bond said molded rod guide to a portion of said rod; and said one or more adhesive channels and said one or more beveled ends with said adhesive in said interior surface provide a mechanical interference to movement along said center axis.

11. A molded rod guide for guiding and protecting a sucker rod in a fluid mineral extraction setting, wherein:

said molded rod guide further comprises a one or more fill ports, an interior surface, a one or more adhesive channels, a cavity and an adhesive;

said one or more adhesive channels line said interior surface of a center channel;

said one or more adhesive channels comprise spaces between said interior surface on said center channel;

said molded rod guide is configured to selectively attach to a rod by attaching a two mating portions around a portion of said rod, attaching a first mating portion to a second mating portion, injecting said adhesive into said one or more fill ports, and filling said cavity with portions of said adhesive;

said one or more adhesive channels force portions of said adhesive into said interior surface;

said one or more fill ports comprise holes in a portion of a plurality of flutes;

said molded rod guide comprise an exterior surface and an interior surface;

said exterior surface comprises a space within said center channel;

said one or more fill ports is configured to receive a portion of said adhesive and channel a portion of said adhesive between said one or more adhesive channels;

said molded rod guide further comprises a one or more beveled ends at a first end and a second end of said center channel;

said second end are configured to press into said rod with said molded rod guide in an assembled configuration;

said interior surface comprises a space between said center channel, said one or more adhesive channels, and said one or more beveled ends;

said one or more adhesive channels comprise at least a first adhesive channel and a second adhesive channel;

said one or more adhesive channels comprise a one or more gaps configured to allow portions of said adhesive to pass between said one or more adhesive channels;

said one or more beveled ends and said one or more adhesive channels are configured to fit snuggly around said rod;

said interior surface are configured to provide a cavity for holding said adhesive between said one or more adhesive channels, and said one or more beveled ends;

said adhesive is configured to bond said molded rod guide to a portion of said rod; and said one or more adhesive channels and said one or more beveled ends with said adhesive in said interior surface provide mechanical resistance to movement along a center axis.

12. A method of use of a molded rod guide for guiding and protecting a sucker rod in a fluid mineral extraction setting, comprising:

selectively attaching a two mating portions to one another around a portion of a rod and;

filling a space between said two mating portions and said rod with an adhesive; wherein;

said molded rod guide further comprises a one or more fill ports, an interior surface, a one or more adhesive channels, a cavity and said adhesive;

said one or more adhesive channels line said interior surface of a center channel;

said one or more adhesive channels comprise spaces between said interior surface on said center channel;

said molded rod guide is configured to selectively attach to said rod by attaching said two mating portions around a portion of said rod, attaching a first mating portion to a second mating portion, injecting said adhesive into said one or more fill ports, and filling said cavity with portions of said adhesive;

said one or more adhesive channels force portions of said adhesive into said interior surface;

said one or more fill ports comprise holes in a portion of a plurality of flutes;

said molded rod guide comprise an exterior surface and an interior surface;

said exterior surface comprises a space within said center channel; and said one or more fill ports is configured to receive a portion of said adhesive and channel a portion of said adhesive between said one or more adhesive channels.

13. A molded rod guide for guiding and protecting a sucker rod in a fluid mineral extraction setting, wherein:

said molded rod guide comprising a two mating portions and a center channel;

said two mating portions comprise a first mating portion and a second mating portion;

said two mating portions are configured to selectively mate with one another and form said center channel;

said two mating portions comprise an assembled configuration and a separated configuration;

with said two mating portions in said assembled configuration, said molded rod guide comprises a plurality of flutes, a body portion, a width and a height;

said body portion wraps around said center channel;

said center channel comprises a center axis;

said molded rod guide is configured to selectively surround a portion of a rod by wrapping said center channel around a portion of said rod;

said plurality of flutes extend in a radially outward direction from said center axis and said body portion;

said molded rod guide further comprises a one or more fill ports, an interior surface, a one or more adhesive channels, a cavity and an adhesive;

said one or more adhesive channels line said interior surface of said center channel;

said one or more adhesive channels comprise spaces between said interior surface on said center channel;

said molded rod guide is configured to selectively attach to said rod by attaching said two mating portions around a portion of said rod, attaching said first mating portion to said second mating portion, injecting said adhesive into said one or more fill ports, and filling said cavity with portions of said adhesive; and said one or more adhesive channels force portions of said adhesive into said interior surface.

* * * * *